US009016249B2

(12) United States Patent
Roberts et al.

(10) Patent No.: US 9,016,249 B2
(45) Date of Patent: Apr. 28, 2015

(54) INTEGRATED LOST MOTION ROCKER BRAKE WITH AUTOMATIC RESET

(71) Applicant: Jacobs Vehicle Systems, Inc., Bloomfield, CT (US)

(72) Inventors: Gabriel Scott Roberts, Wallingford, CT (US); Justin Damien Baltrucki, Manchester, CT (US); Scott Nelson, Bolton, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 73 days.

(21) Appl. No.: 14/035,707

(22) Filed: Sep. 24, 2013

(65) Prior Publication Data

US 2014/0083381 A1 Mar. 27, 2014

Related U.S. Application Data

(60) Provisional application No. 61/704,742, filed on Sep. 24, 2012.

(51) Int. Cl.

| | |
|---|---|
| ***F01L 1/34*** | (2006.01) |
| ***F01L 1/18*** | (2006.01) |
| ***F01L 1/08*** | (2006.01) |
| ***F01L 13/06*** | (2006.01) |
| *F01L 1/26* | (2006.01) |

(52) U.S. Cl.

CPC ... *F01L 1/18* (2013.01); *F01L 1/08* (2013.01); *F01L 1/181* (2013.01); *F01L 1/267* (2013.01); *F01L 13/06* (2013.01)

(58) Field of Classification Search

CPC ..... F01L 1/18; F01L 1/08; F01L 13/06; F01L 1/181; F01L 1/267

USPC ..... 123/90.22, 90.39, 90.16, 90.15, 90.1

See application file for complete search history.

(56) References Cited

U.S. PATENT DOCUMENTS

| | | | |
|---|---|---|---|
| 3,220,392 | A | 11/1965 | Cummins |
| 4,592,319 | A | 6/1986 | Meistrick |
| 5,934,263 | A | 8/1999 | Russ et al. |
| 6,234,143 | B1 | 5/2001 | Bartel et al. |
| 6,253,730 | B1 | 7/2001 | Gustafson |
| 6,386,160 | B1 | 5/2002 | Meneely et al. |

(Continued)

FOREIGN PATENT DOCUMENTS

| | | | |
|---|---|---|---|
| CN | 201255016 | Y | 6/2009 |

OTHER PUBLICATIONS

Mack Powerleash Engine Brake, Mack Trucks, Inc. Service Bulletin SB-266-016, May 15, 2003, Allentown, PA.

(Continued)

*Primary Examiner* — Zelalem Eshete
(74) *Attorney, Agent, or Firm* — Vedder Price, P.C.

(57) ABSTRACT

Systems and methods for actuating engine valves are disclosed. The systems may include a rocker arm having an adjustable length push tube mounted to a first end and multiple contact surfaces for an engine valve bridge at a second end. An actuator piston assembly may be provided in the rocker arm between the first and second rocker arm ends. The actuator piston assembly is adapted to extend from the rocker arm under the influence of hydraulic pressure and actuate an inboard engine valve through the engine valve bridge when an actuator piston is locked into an extended position.

36 Claims, 16 Drawing Sheets

(56) References Cited

U.S. PATENT DOCUMENTS

| | | | |
|---|---|---|---|
| 6,450,144 | B2 | 9/2002 | Janak et al. |
| 6,510,824 | B2 | 1/2003 | Vorih et al. |
| 6,594,996 | B2 | 7/2003 | Yang |
| 6,694,933 | B1 | 2/2004 | Lester |
| 6,883,492 | B2 | 4/2005 | Vanderpoel et al. |
| 7,712,449 | B1 | 5/2010 | Schwoerer |
| 7,905,208 | B2 | 3/2011 | Ruggiero et al. |
| 2010/0065019 | A1 | 3/2010 | Yang |
| 2010/0319657 | A1 | 12/2010 | Dodi et al. |
| 2012/0024260 | A1 | 2/2012 | Groth |
| 2012/0048232 | A1 | 3/2012 | Meistrick |
| 2012/0298057 | A1 | 11/2012 | Janak et al. |

OTHER PUBLICATIONS

Search Report and Written Opinion issued in PCT/US2013/061453 on Feb. 21, 2014.

INTEGRATED LOST MOTION ROCKER BRAKE WITH AUTOMATIC RESET

CROSS-REFERENCE TO RELATED APPLICATIONS

The present application relates to, and claims the priority of, U.S. Provisional Patent Application Ser. No. 61/704,742, filed Sep. 24, 2012, which is entitled "Integrated Lost Motion Rocker Brake With Automatic Reset."

FIELD OF THE INVENTION

The present invention relates to systems and methods for actuating valves in internal combustion engines.

BACKGROUND OF THE INVENTION

Internal combustion engines typically use either a mechanical, electrical, or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder. Near the end of the exhaust stroke, another lobe on the camshaft may open the intake valve for the main intake event at which time the piston travels away from the cylinder head. The intake valve closes and the intake stroke ends when the piston is near bottom dead center. Both the intake and exhaust valves are closed as the piston again travels upward for the compression stroke.

The above-referenced main intake and main exhaust valve events are required for positive power operation of an internal combustion engine. Additional auxiliary valve events, while not required, may be desirable. For example, it may be desirable to actuate the intake and/or exhaust valves during positive power or other engine operation modes for compression-release engine braking, bleeder engine braking, partial bleeder engine braking, exhaust gas recirculation (EGR), brake gas recirculation (BGR), or other auxiliary intake and/or exhaust valve events. FIG. 12 illustrates examples of a main exhaust event 600, and auxiliary valve events, such as a compression-release engine braking event 610, bleeder engine braking event 620, exhaust gas recirculation event 640, and brake gas recirculation event 630, which may be carried out by an engine valve using various embodiments of the present invention to actuate engine valves for main and auxiliary valve events.

With respect to auxiliary valve events, flow control of exhaust gas through an internal combustion engine has been used in order to provide vehicle engine braking. Generally, engine braking systems may control the flow of exhaust gas to incorporate the principles of compression-release type braking, exhaust gas recirculation, exhaust pressure regulation, and/or bleeder type braking.

During compression-release type engine braking, the exhaust valves may be selectively opened to convert, at least temporarily, a power producing internal combustion engine into a power absorbing air compressor. As a piston travels upward during its compression stroke, the gases that are trapped in the cylinder may be compressed. The compressed gases may oppose the upward motion of the piston. As the piston approaches the top dead center (TDC) position, at least one exhaust valve may be opened to release the compressed gases in the cylinder to the exhaust manifold, preventing the energy stored in the compressed gases from being returned to the engine on the subsequent expansion down-stroke. In doing so, the engine may develop retarding power to help slow the vehicle down. An example of a prior art compression release engine brake is provided by the disclosure of the Cummins, U.S. Pat. No. 3,220,392 (November 1965), which is hereby incorporated by reference.

During bleeder type engine braking, in addition to, and/or in place of, the main exhaust valve event, which occurs during the exhaust stroke of the piston, the exhaust valve(s) may be held slightly open during the remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) in a bleeder braking operation is in advance of the compression TDC (i.e., early valve actuation) and then lift is held constant for a period of time. As such, a bleeder type engine brake may require lower force to actuate the valve(s) due to early valve actuation, and generate less noise due to continuous bleeding instead of the rapid blow-down of a compression-release type brake.

Exhaust gas recirculation (EGR) systems may allow a portion of the exhaust gases to flow back into the engine cylinder during positive power operation. EGR may be used to reduce the amount of $NO_x$ created by the engine during positive power operations. An EGR system can also be used to control the pressure and temperature in the exhaust manifold and engine cylinder during engine braking cycles. Generally, there are two types of EGR systems, internal and external. External EGR systems recirculate exhaust gases back into the engine cylinder through an intake valve(s). Internal EGR systems recirculate exhaust gases back into the engine cylinder through an exhaust valve(s) and/or an intake valve(s). Embodiments of the present invention primarily concern internal EGR systems.

Brake gas recirculation (BGR) systems may allow a portion of the exhaust gases to flow back into the engine cylinder during engine braking operation. Recirculation of exhaust gases back into the engine cylinder during the intake stroke, for example, may increase the mass of gases in the cylinder that are available for compression-release braking. As a result, BGR may increase the braking effect realized from the braking event.

In many internal combustion engines, the engine intake and exhaust valves may be opened and closed by fixed profile cams, and more specifically by one or more fixed lobes or bumps which may be an integral part of each of the cams. Benefits such as increased performance, improved fuel economy, lower emissions, and better vehicle drivability may be obtained if the intake and exhaust valve timing and lift can be varied. The use of fixed profile cams, however, can make it difficult to adjust the timings and/or amounts of engine valve lift to optimize them for various engine operating conditions.

One method of adjusting valve timing and lift, given a fixed cam profile, has been to provide variable valve actuation and incorporate a "lost motion" device in the valve train linkage between the valve and the cam. Lost motion is the term applied to a class of technical solutions for modifying the valve motion proscribed by a cam profile with a variable length mechanical, hydraulic, or other linkage assembly. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

Proper control of the engine valve lift and actuation timing when utilizing a lost motion system may improve engine performance and reliability during engine braking, positive power, and/or EGR/BGR operation. For example, during engine braking, the main exhaust event may experience an added valve lift because lash in the system may be taken up. This added valve lift may create an increased overlap between the main exhaust event and the main intake event, and cause excess exhaust gases to flow back into the cylinder and into the intake manifold. This result may lead to braking and EGR performance issues, such as higher injector tip temperature and lower engine retarding power. In addition, the added valve lift may cause reliability issues, including increased potential of valve-to-piston contact. Accordingly, by reducing or eliminating the added valve lift during engine braking, braking performance and engine reliability may be improved. This object may be provided by one or more embodiments of the present invention.

Proper control of the engine valve lift and timing may also lead to improvements during positive power operation. For example, main intake event timing may be modified such that the intake valve closes earlier than a standard main intake valve event. This process is known as a Miller Cycle. Controlling the main intake event valve timing may lead to improved fuel economy and emissions.

Cost, packaging, and size are factors that may often determine the desirableness of an engine brake or valve actuation system. Additional systems that may be added to existing engines are often cost-prohibitive and may have additional space requirements due to their bulky size. Pre-existing engine brake systems may avoid high cost or additional packaging, but the size of these systems and the number of additional components may often result in lower reliability and difficulties with size. It is thus often desirable to provide an integral engine braking system that may be low cost, provide high performance and reliability, and yet not provide space or packaging challenges.

Embodiments of the systems and methods of the present invention may be particularly useful in engines requiring valve actuation for positive power, engine braking valve events and/or EGR/BGR valve events. Some, but not necessarily all, embodiments of the present invention may provide a system and method for selectively actuating engine valves utilizing a lost motion system, particularly a lost motion system integrated into a rocker arm. Some, but not necessarily all, embodiments of the present invention may provide improved engine performance and efficiency during positive power, engine braking, and/or EGRIBGR operation. Additional advantages of embodiments of the invention are set forth, in part, in the description which follows and, in part, will be apparent to one of ordinary skill in the art from the description and/or from the practice of the invention.

SUMMARY OF THE INVENTION

Responsive to the foregoing challenges, Applicant has developed an innovative system for actuating an engine valve comprising: a rocker arm having a first end distal from a valve bridge and a second end proximal to the valve bridge, said rocker arm having a first surface at the second end adapted to act on a center portion of the valve bridge; a sliding pin provided in, or a contact surface provided on, said valve bridge adjacent to the center portion, said valve bridge having a lower surface below said sliding pin or contact surface which is adapted to contact an engine valve; an actuator piston slidably disposed within and extending from the rocker arm at a point between the rocker arm first end and second end, said actuator piston having a lower surface adapted to contact the sliding pin or contact surface of the valve bridge; a hydraulically actuated mechanical locking assembly disposed in said rocker arm, said mechanical locking assembly contacting said actuator piston; and a hydraulic passage extending through the rocker arm to the mechanical locking assembly.

Applicant has further developed an innovative system for actuating an engine valve comprising: a rocker arm having a first end distal from a valve bridge and a second end proximal to the valve bridge, said rocker arm having a first surface at the second end which is adapted to act on a center portion of the valve bridge; a sliding pin provided in, or a contact surface provided on, said valve bridge adjacent to the center portion, said valve bridge having a surface below said sliding pin or contact surface which is adapted to contact an engine valve; an actuator piston slidably disposed within and extending from the rocker arm at a point between the rocker arm first end and second end, said actuator piston having a lower surface adapted to contact the sliding pin or contact surface of the valve bridge; a stop surface provided on or connected to the actuator piston, said stop surface adapted to limit movement of the actuator piston relative to the rocker arm; an actuator piston lash adjustment assembly provided in the rocker arm; a hydraulic passage extending through the rocker arm to a bore in which the actuator piston is disposed; and a control valve provided in the rocker arm, said control valve communicating with the hydraulic passage and adapted to maintain the actuator piston in contact with the stop surface for a plurality of engine cycles.

Applicant has still further developed an innovative method of actuating an engine valve using a valve bridge and a rocker arm, said rocker arm having an actuator piston assembly adapted to contact the valve bridge and a reset piston assembly in contact with the actuator piston assembly, said method comprising the steps of: supplying hydraulic fluid to the actuator piston assembly to cause it to attain an extended position relative to the rocker arm and to mechanically engage the reset piston assembly; and pivoting the rocker arm so that the actuator piston assembly actuates the engine valve and so that the reset piston assembly is forced to move relative to the rocker arm thereby mechanically forcing the actuator piston assembly to move relative to the reset piston assembly and unlock the actuator piston assembly from the extended position.

Applicant has still further developed an innovative method of actuating an engine valve using a valve bridge and a rocker arm, said rocker arm having an actuator piston assembly adapted to contact the valve bridge and a reset piston assembly adjacent to the actuator piston assembly, said method comprising the steps of: supplying hydraulic fluid to the actuator piston assembly to cause it to extend from the rocker arm and to become mechanically locked into an extended position; and pivoting the rocker arm so that the actuator piston assembly actuates the engine valve and so that the reset piston assembly is forced to move relative to the rocker arm and hydraulically unlock the actuator piston assembly from the extended position.

Applicant has still further developed an innovative method of actuating an engine valve using a valve bridge and a rocker shaft mounted rocker arm, said rocker arm having a first contact surface adapted to contact a center portion of the valve bridge and an actuator piston assembly adapted to contact a portion of the valve bridge closer to the rocker shaft than the center portion of the valve bridge, said method comprising the steps of: supplying hydraulic fluid to the actuator piston assembly to cause it to extend from the rocker arm and to become mechanically locked into an extended position; and pivoting the rocker arm so that the actuator piston assembly actuates the engine valve during a first part of the pivoting motion and the rocker arm first contact surface actuates the engine valve during a second part of the pivoting motion.

Applicant has still further developed an innovative method of actuating an engine valve using a valve bridge and a rocker shaft mounted rocker arm, said rocker arm having a first contact surface adapted to contact a center portion of the valve bridge and an actuator piston assembly adapted to contact a portion of the valve bridge closer to the rocker shaft than the center portion of the valve bridge, said method comprising the steps of: supplying hydraulic fluid to the actuator piston assembly to cause it to extend from the rocker arm and to become hydraulically locked into an extended position; pivoting the rocker arm so that the actuator piston assembly actuates the engine valve during a first part of the pivoting motion and the rocker arm first contact surface actuates the engine valve during a second part of the pivoting motion; and maintaining the actuator piston assembly in the extended position for a plurality of engine cycles.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements.

DETAILED DESCRIPTION OF EMBODIMENTS OF THE INVENTION

Figure 1:
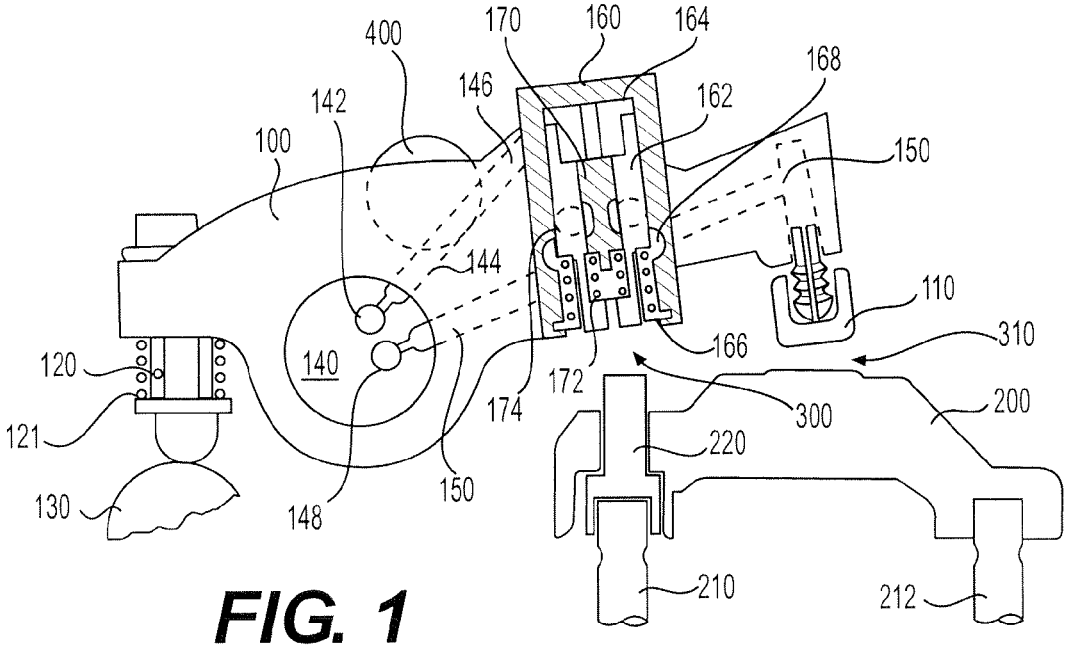
FIG. 1 is a schematic view in partial cross-section of a rocker arm and valve bridge system assembled in accordance with a first embodiment of the present invention in an engine brake off position.

Reference will now be made in detail to embodiments of the present invention, examples of which are illustrated in the accompanying drawings. With reference to FIGS. 1-8 and 13-23, systems for actuating engine valves are shown. While the systems may be used for intake, exhaust, and/or auxiliary engine valve actuation, in a preferred embodiment, the system is used to provide main exhaust valve actuation for two exhaust valves and compression release engine braking actuation for one of the two exhaust valves. Accordingly, the systems shown in FIGS. 1-8 and 13-23 will be described as used for main exhaust and compression release engine braking.

With reference to FIGS. 1-4 and 13, schematic views in partial cross-section are shown of an exhaust rocker arm 100 and an associated exhaust valve bridge 200 in accordance with a first embodiment of the present invention. The exhaust valve bridge 200 is preferably a "floating" bridge, meaning that there is no central guide below the valve bridge which permits the floating bridge to tilt relative to the engine valve stems 210 and 212 that it bridges (see tilt angle 230 in FIGS. 3 and 7). The valve bridge 200 may include a sliding pin 220, or contact surface in an alternative embodiment, which is received in an opening provided in the valve bridge above the inboard exhaust valve 210. The sliding pin may be capable of translating downward relative to the valve bridge 200, instead of or in addition to the tilting of the valve bridge, to permit actuation of the inboard exhaust valve 210 without actuation of the outboard exhaust valve 212. It is appreciated that a contact surface provided integrally with the valve bridge 200 may be substituted in alternative embodiments for the sliding pin 220.

The rocker arm 100 may include a rocker shaft bore extending through a central portion of the rocker arm. The rocker shaft bore may be adapted to receive a rocker shaft 140 and the rocker arm 100 may be pivoted about the rocker shaft as a result of motion imparted to it by a cam 130 acting on the rocker arm through a push tube 120, directly or by some other motion imparting device. The rocker arm 100 is adapted to selectively actuate the exhaust valves 210 and 212 as a result of contact with the valve bridge 200 and the sliding pin 220 during pivoting motion of the rocker arm. The exhaust valve 210, referred to as the inboard exhaust valve, may be closer to the rocker shaft 140 than the outboard exhaust valve 212.

Figure 10:
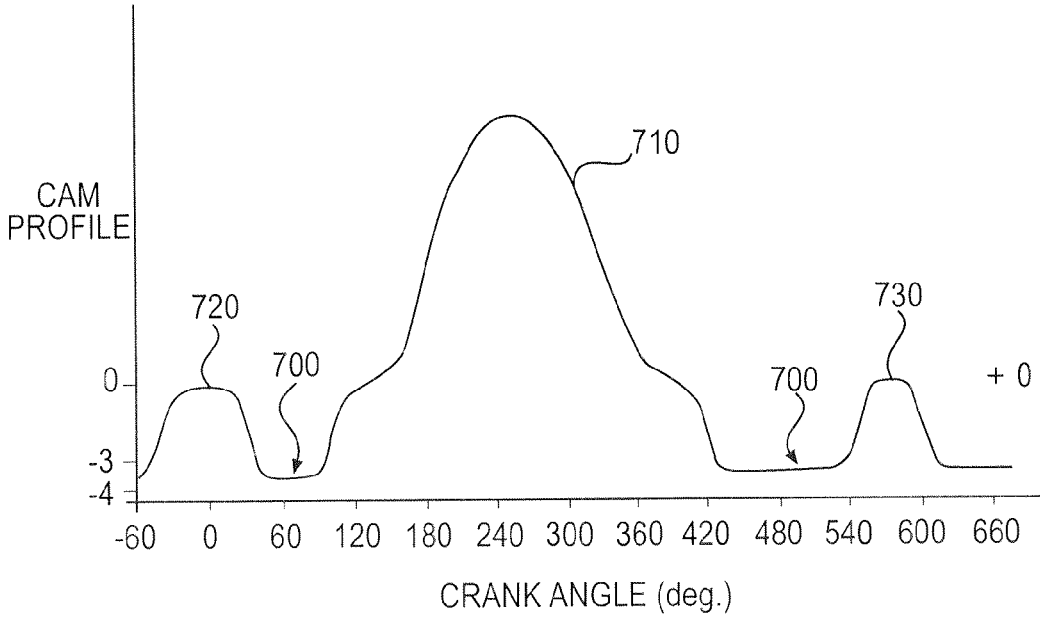
FIG. 10 is a graph of an exhaust valve cam profile for providing compression release braking in accordance with an embodiment of the present invention.
Figure 12:
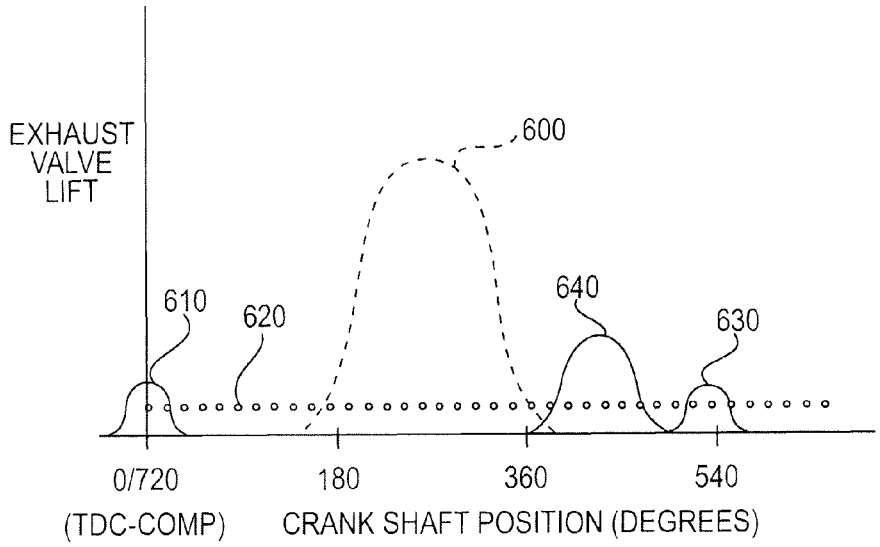
FIG. 12 is a graph of a number of different and exemplary auxiliary valve events.

With reference to FIG. 10, in a preferred embodiment, the cam 130 that actuates the rocker arm 100 may include base circle portions 700 and one or more bumps or lobes for providing a pivoting motion to the rocker arm 100. Preferably, the cam includes a main exhaust bump 710 which may selectively open the exhaust valves 210 and 212 during an exhaust stroke for an engine cylinder, and a compression release engine braking bump 720 and brake gas recirculation bump 730 for opening only the inboard exhaust valve 210 during engine braking.

Figure 2:
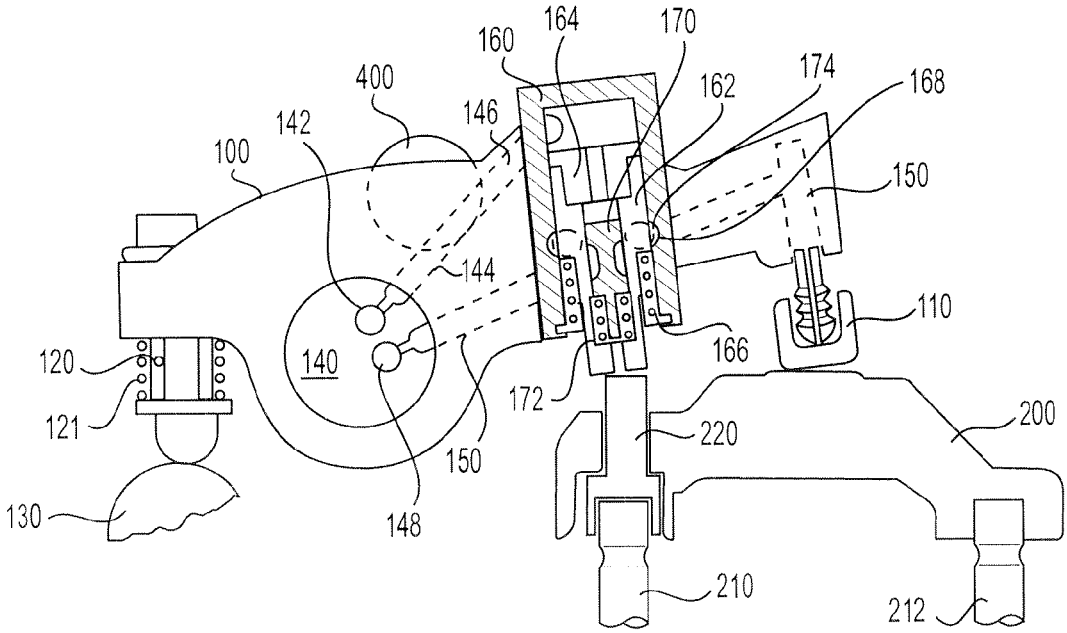
FIG. 2 is a schematic view in partial cross-section of a rocker arm and valve bridge system assembled in accordance with the first embodiment of the present invention in an engine brake on position at the initiation of an engine braking event.
Figure 3:
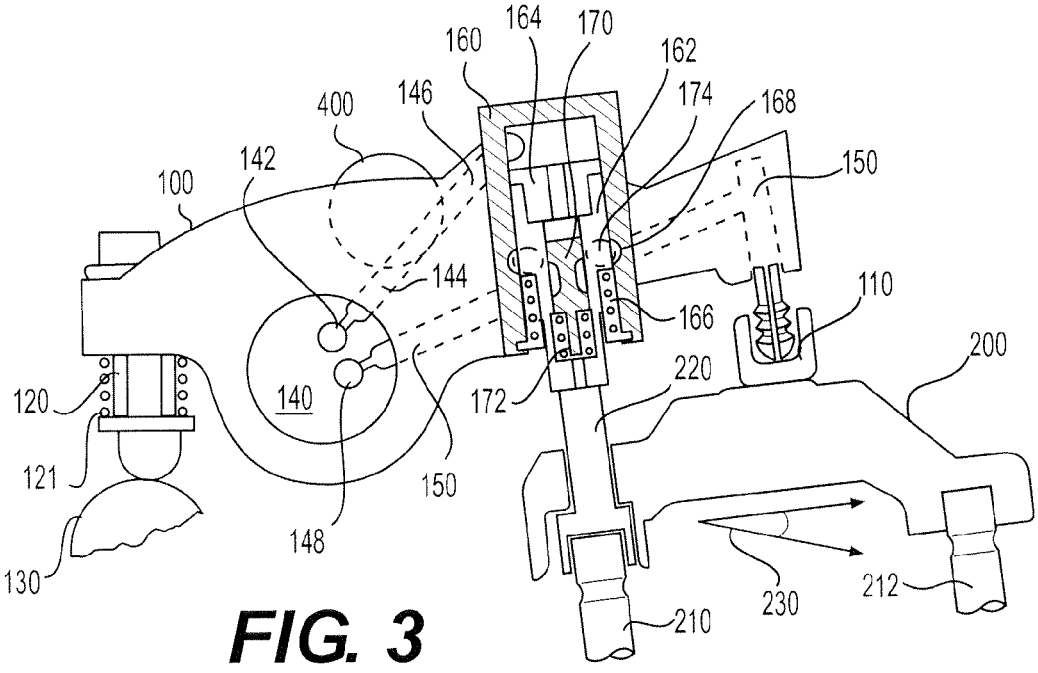
FIG. 3 is a schematic view in partial cross-section of a rocker arm and valve bridge system assembled in accordance with the first embodiment of the present invention in an engine brake on position during hand-off from engine braking to main event actuation.
Figure 4:
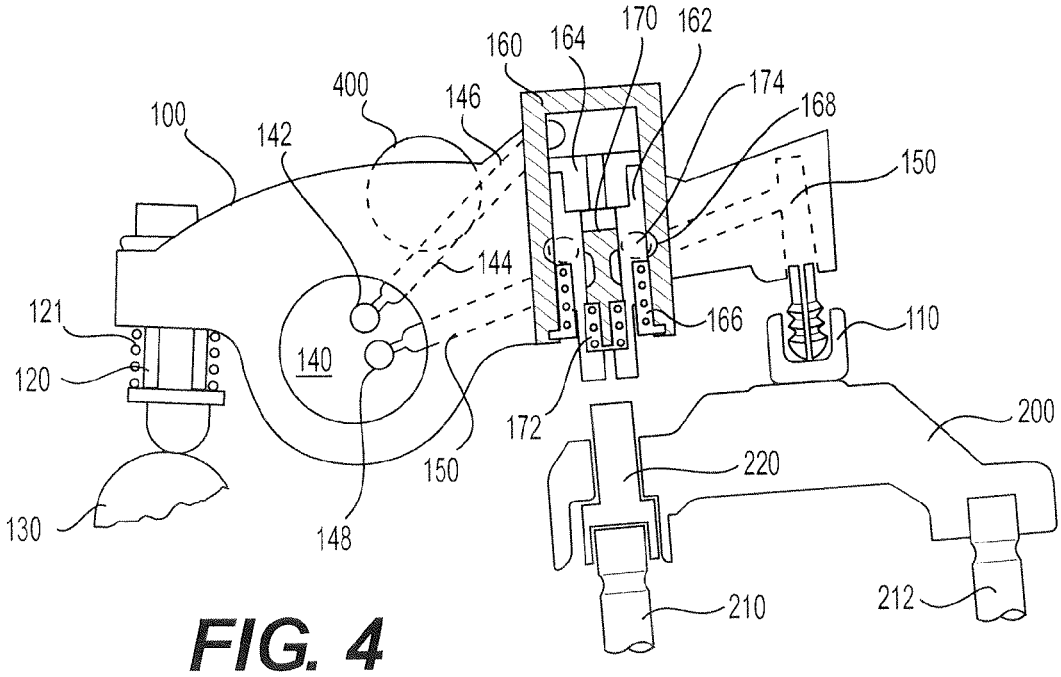
FIG. 4 is a schematic view in partial cross-section of a rocker arm and valve bridge system assembled in accordance with the first embodiment of the present invention in an engine brake on position at the point of maximum main event valve lift.

With renewed reference to FIGS. 1-4 and 13, a multi-piece push tube 120 may be provided as an adjusting screw assembly including an upper screw end extending through the rocker arm 100, lower spring biased end, a spring 121, and a threaded nut which may lock the upper screw end in place. The length of the upper screw end of the push tube 120 extending below the rocker arm 100 towards the cam 130 may be adjusted by screwing it into or out of the rocker arm. The lash space 310 between the rocker arm 100 and the valve bridge 200, when the cam 130 is at base circle, may be eliminated and transferred to the push tube 120 end of the rocker arm by screwing the upper screw end of the push tube 120 into or out of the rocker arm 100. The spring 121 may bias the lower spring biased end of the push tube 120 into contact with the cam 130 and bias the rocker arm 100 into contact with the valve bridge 200 throughout engine operation, as shown in FIGS. 2-4.

The rocker shaft 140 may include one or more internal passages for the delivery of hydraulic fluid, such as engine oil, to the rocker arm 100 mounted thereon. Specifically, the rocker shaft 140 may include a constant fluid supply passage 148 and a control fluid supply passage 142. The rocker shaft bore may include one or more ports formed in the wall thereof to receive fluid from the fluid passages formed in the rocker shaft 140. The constant fluid supply passage 148 may provide lubricating fluid to the swivel foot mechanism 110 through a first rocker passage 150 extending through the rocker arm 100. The control fluid supply passage 142 may provide hydraulic fluid to a control valve 400 through a second rocker passage 144, and the control valve may provide hydraulic fluid to an actuator piston assembly 160 through a third rocker passage 146 provided in the rocker arm 100.

Figure 13:
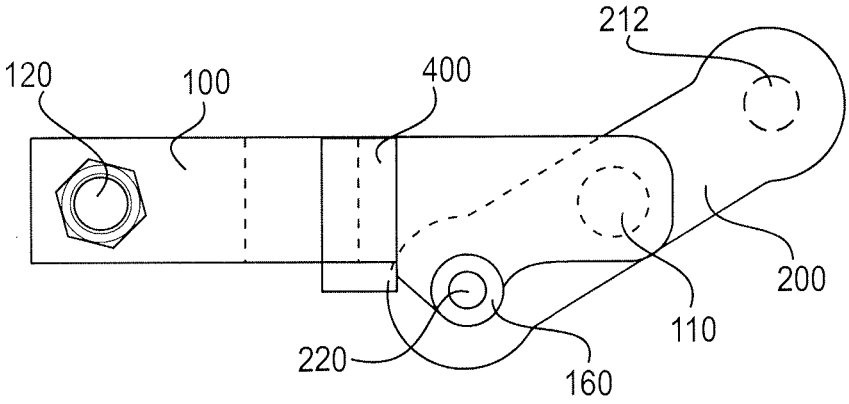
FIG. 13 is an overhead view of a rocker arm and valve bridge system assembled in accordance with the first and second embodiments of the present invention.

As shown in FIG. 13, the actuator piston assembly 160 may be provided in a laterally offset portion or boss of the rocker arm 100 positioned above the sliding pin 220. A central opening in the boss may receive an actuator piston 162, a cap 164, an inner plunger 170, an inner plunger spring 172, an actuator piston spring 166, and one or more wedge, roller or ball locking elements 174. The cap 164 and the actuator piston 162 may include interior bores extending vertically through each. The actuator piston 162 may further include a side opening extending through the actuator piston wall for receiving the wedge, rollers or ball locking elements 174. The combination of the inner plunger 170 and the one or more wedge, roller or ball locking elements 174 may be referred to as a mechanical locking assembly for the actuator piston 162. As explained below, the mechanical locking assembly may be hydraulically actuated.

The inner plunger 170 may be slidably disposed in the vertical bore extending through the actuator piston 162. The inner plunger 170 may include an annular recess or ramped portion, shaped to receive the one or more wedge, roller or ball locking elements 174 when the inner plunger is urged by the inner plunger spring 172 into the position shown in FIG. 1. The outer wall of the actuator piston assembly 160 may also include one or more recesses 168 for receiving the one or more wedge, roller or ball locking elements 174 in a manner that permits the one or more wedge, roller or ball locking elements to lock the actuator piston 162 and the actuator piston assembly 160 outer wall together, as shown in FIGS. 2-4. The actuator piston spring 166 may normally bias the actuator piston 162 upward in the vertical bore provided in the actuator piston assembly 160 boss so that the cap 164 contacts the vertical bore end wall. The inner plunger spring 172 may normally bias the inner plunger 170 upward in the actuator piston assembly vertical bore so that it contacts the end cap 164.

Figure 9:
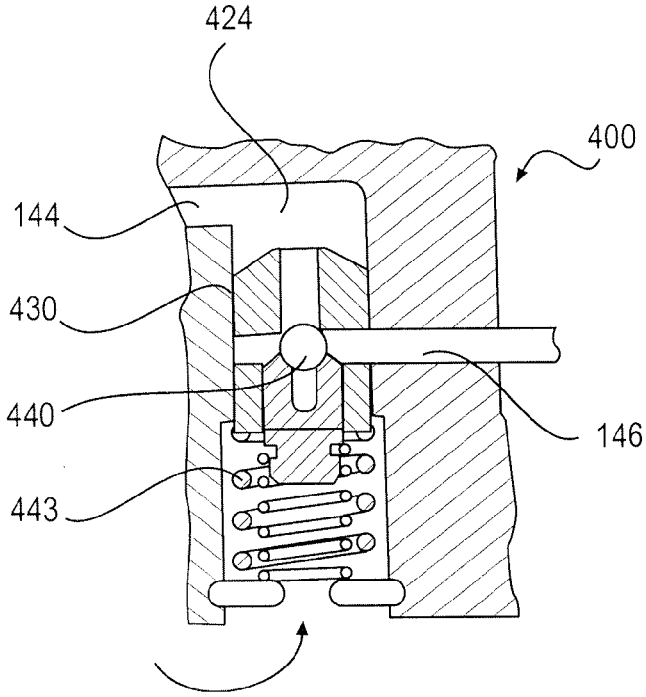
FIG. 9 is a schematic view in cross-section of a control valve which may be used in the systems assembled in accordance with the first and second embodiments of the invention.

FIG. 9 shows the detail of the control valve 400 which may be used in the first and second embodiments of the present invention. The control valve piston 430 may be a cylindrically shaped element with one or more internal passages, and which may incorporate an internal control check valve 440. The check valve 440 may permit fluid to pass from the first rocker passage 144 to the second rocker passage 146, but not in the reverse direction. The control valve piston 430 may be spring biased by one or more control valve springs 433 into the control valve bore 424 toward a port that connects the control valve bore to the first rocker passage 144. A central internal passage may extend axially from the inner end of the control valve piston 430 towards the middle of the control valve piston where the control check valve 440 may be located. The central internal passage in the control valve piston 430 may communicate with one or more passages extending across the diameter of the control valve piston 430. As a result of translation of the control valve piston 430 relative to its bore 424, the passages extending through the control valve piston 430 may selectively register with a port that connects the side wall of the control valve bore with the second rocker passage 146.

During positive power operation, a solenoid valve (not shown) may be positioned so that no significant hydraulic fluid pressure is provided through first rocker passage 144 to the control valve 400. As a result, hydraulic fluid pressure is not provided to the actuator piston assembly 160 and the actuator piston spring 166 maintains the actuator piston 162 out of contact with the sliding pin 220. In turn, the only valve actuation motion imparted to the exhaust valves 210 and 212 occurs as a result of the main exhaust lobe of cam 130 pivoting the swivel foot 110 against the valve bridge 200.

During engine braking, hydraulic fluid may be selectively supplied from the solenoid valve (not shown), through the control fluid supply passage 142, control valve 400, and the first and second rocker passages 144 and 146 to the actuator piston assembly 160. The supply of hydraulic fluid may displace both the actuator piston 162 and the inner plunger 170 against the bias of the actuator piston spring 166 and the inner plunger spring 172. When the inner plunger 170 is displaced sufficiently, the inner plunger 170 may force the wedge, ball or roller locking elements 174 into the one or more recesses 168 in the actuator piston assembly wall, which in turn may mechanically lock the actuator piston 162 to the rocker arm 100. As a result, during this "locked" state, valve actuation motion applied by the compression release lobe 720 (FIG. 10) and the brake gas recirculation lobe 730, and the lower portion of the main exhaust lobe 710 may be imparted to the inboard exhaust valve 210 by the sliding pin 220. Valve actuation motion from the upper portion of the main exhaust lobe may be provided to both exhaust valves 210 and 212 by the swivel foot 110 acting on the center portion of the valve bridge 200. Cessation of hydraulic fluid supply to the control valve 400 and the actuator piston assembly 160 permits the actuator piston 162 and the inner plunger 170 to return to their upper positions for positive power operation of the system.

Figure 11:
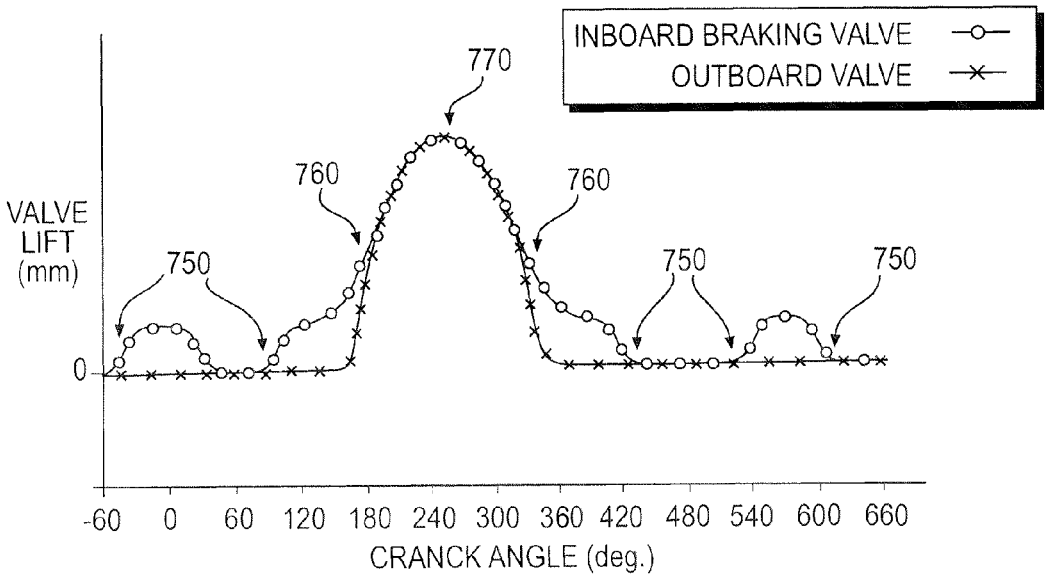
FIG. 11 is a graph of example valve lifts of inboard and outboard exhaust valves during engine braking in accordance with an embodiment of the present invention.

FIG. 2 illustrates the rocker arm 100 and actuator piston assembly 160 as they are about to open or close the inboard exhaust valve 210 for a compression release engine braking event, about to open or close the inboard exhaust valve for main exhaust actuation, and about to open or close the inboard exhaust valve for brake gas recirculation, which valve positions are shown as points 750 in FIG. 11. FIG. 3 illustrates the rocker arm 100 and lost motion actuator 160 as they are about to change from inboard valve actuation only through sliding pin 220 to actuation of both the inboard and outboard exhaust valves 210 and 212 through contact between the swivel foot 110 and the valve bridge 200, which valve positions are shown as points 760 in FIG. 11. As shown in FIG. 11, as a result of the different rocker ratios of the actuator piston assembly 160 relative to the swivel foot 110, actuation of the inboard exhaust valve 210 is handed off at points 760 between the sliding pin 220 and the valve bridge 200. FIG. 4 illustrates the rocker arm 100 and actuator piston assembly 160 as they are at maximum pivoting rotation providing main exhaust valve actuation, which valve positions are shown as point 770 in FIG. 11. The actuator piston 162 may be maintained in an extended position, mechanically locked relative to the rocker arm 100, for a plurality of engine cycles. As a result, pivoting of the rocker arm causes the actuator piston assembly 160 to actuate the inboard exhaust valve 210 during a first part of the pivoting motion using the sliding pin 220 (or contact surface) and the rocker arm swivel foot 110 to actuate the inboard exhaust valve during a second part of the pivoting motion using the valve bridge 200.

With reference to FIGS. 5-8 and 13, schematic views in partial cross-section are shown of an exhaust rocker arm 100 and an associated exhaust valve bridge 200 in accordance with a second embodiment of the present invention in which like reference characters refer to like elements to those illustrated in connection with the first embodiment of the invention. The rocker arm 100 may include a rocker shaft bore extending through a central portion of the rocker arm. The rocker shaft bore may be adapted to receive a rocker shaft 140 and the rocker arm 100 may be pivoted about the rocker shaft as a result of motion imparted to it by a cam 130 acting on the rocker arm through a push tube 120 or by some other motion imparting device. The rocker arm 100 is adapted to selectively actuate the exhaust valves 210 and 212 as a result of contact with the valve bridge 200 and the sliding pin 220, or contact surface on the valve bridge, during pivoting motion of the rocker arm.

Figure 5:
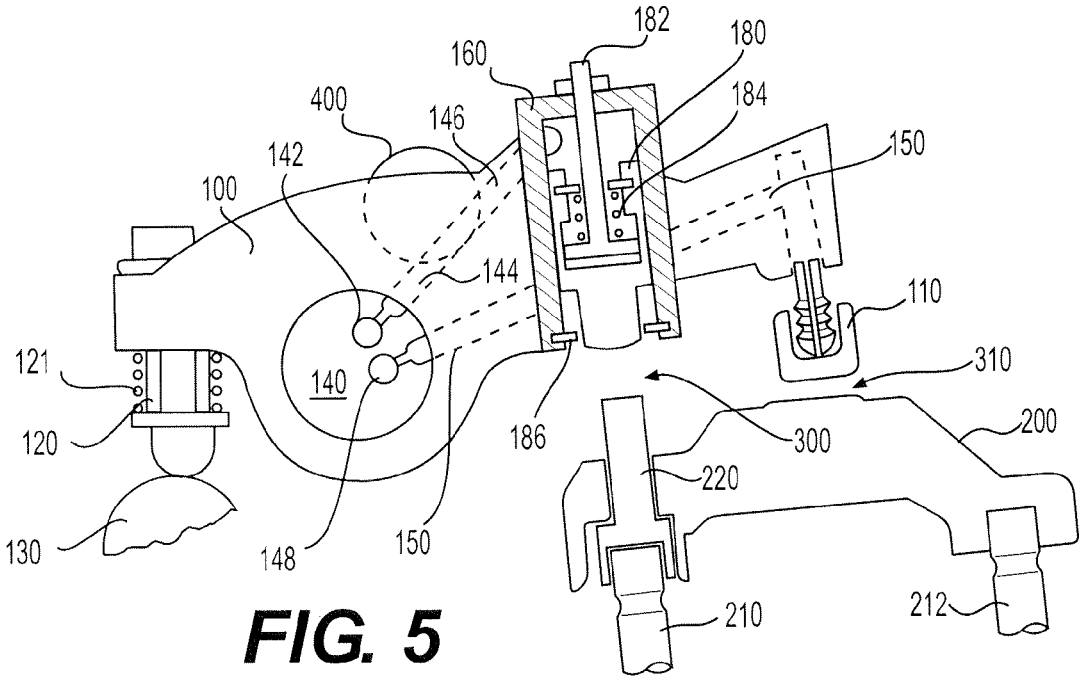
FIG. 5 is a schematic view in partial cross-section of a rocker arm and valve bridge system assembled in accordance with a second embodiment of the present invention in an engine brake off position.

The multi-piece push tube 120 may operate as explained in connection with the embodiment of FIGS. 1-4 to eliminate the lash space 310 between the swivel foot 110 and the valve bridge 200 shown in FIG. 5 before lash adjustment. Further, the rocker shaft 140 may include one or more internal passages for the delivery of hydraulic fluid, such as engine oil, to the rocker arm 100 mounted thereon, including constant fluid supply passage 148 and a control fluid supply passage 142 which operate as explained in connection with the embodiment of FIGS. 1-4. The control fluid supply passage 142 may provide hydraulic fluid to a control valve 400 through a second rocker passage 144, and the control valve may provide hydraulic fluid to the actuator piston assembly 160 through a third rocker passage 146 provided in the rocker arm 100.

Figure 6:
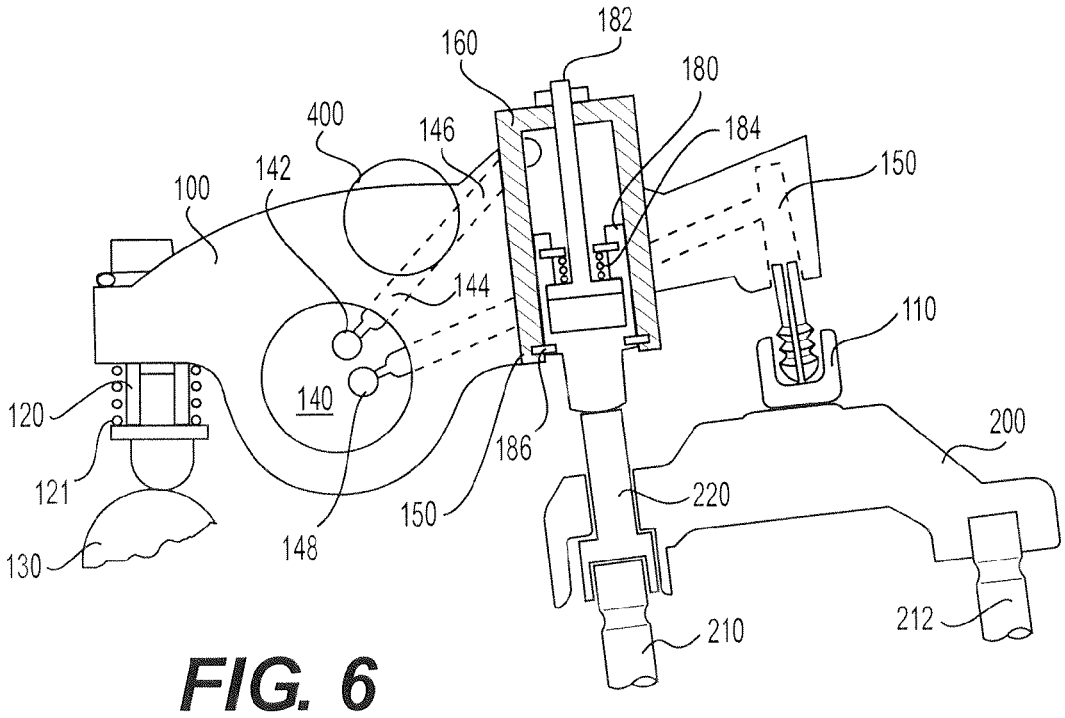
FIG. 6 is a schematic view in partial cross-section of a rocker arm and valve bridge system assembled in accordance with the second embodiment of the present invention in an engine brake on position at the initiation of an engine braking event.
Figure 7:
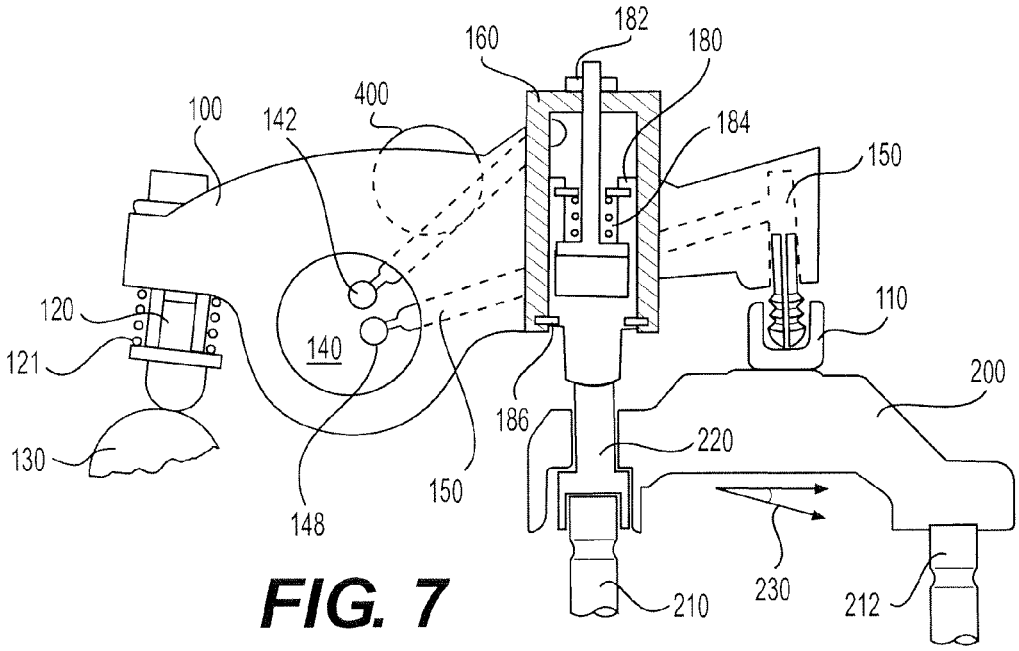
FIG. 7 is a schematic view in partial cross-section of a rocker arm and valve bridge system assembled in accordance with the second embodiment of the present invention in an engine brake on position during hand-off from engine braking to main event actuation.
Figure 8:
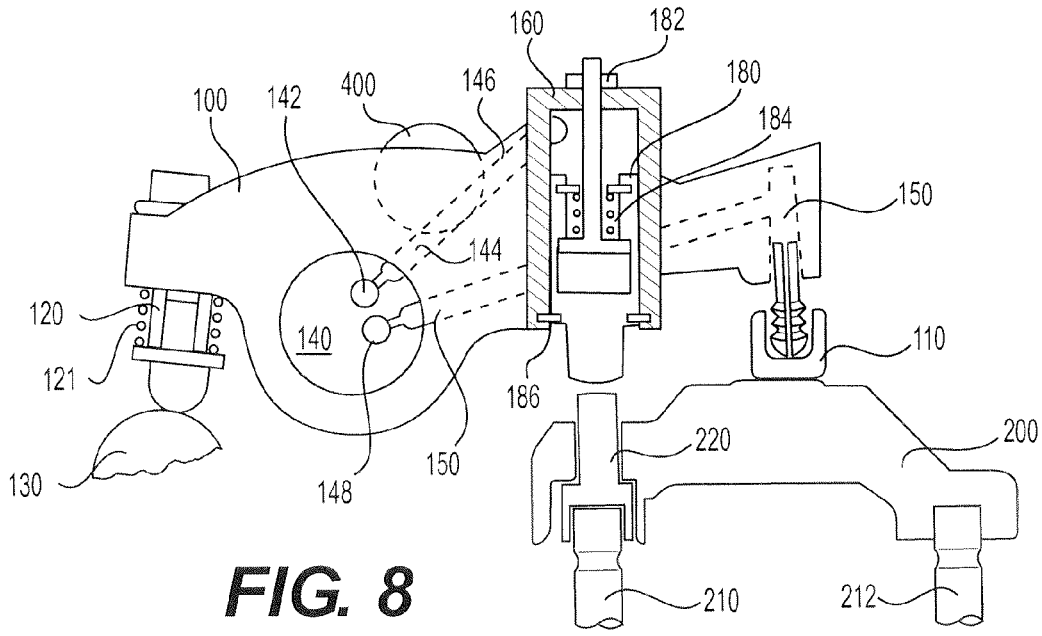
FIG. 8 is a schematic view in partial cross-section of a rocker arm and valve bridge system assembled in accordance with the second embodiment of the present invention in an engine brake on position at the point of maximum main event valve lift.

As shown in FIG. 13, the actuator piston assembly 160 may be provided in a boss extending laterally from the rocker arm 100. With reference to FIGS. 5-8, a central opening in the boss may receive an actuator piston 180, a lash screw 182, and a lash spring 184. The actuator piston 180 may include an internal shoulder, or stop surface, which selectively engages a lower head of the lash screw 182, as shown in FIGS. 6-8. The lash space 300 between the actuator piston 180 and the sliding pin 220 may be adjusted by screwing the lash screw 182 into or out of the actuator piston housing and setting it with a locking nut. The lash spring 184 may bias the lash screw 182 lower head away from the actuator piston 180 internal shoulder, as shown in FIG. 5.

During positive power operation, a solenoid valve (not shown) may be positioned so that no significant hydraulic fluid pressure is provided through first rocker passage 144 to the control valve 400. As a result, hydraulic fluid pressure is not provided to the actuator piston assembly 160 and the lash spring 184 maintains the actuator piston 180 out of contact with the sliding pin 220. In turn, the only valve actuation motion imparted to the exhaust valves 210 and 212 occurs as a result of the main exhaust lobe of cam 130 pivoting the swivel foot 110 against the valve bridge 200.

During engine braking, hydraulic fluid may be selectively supplied from a solenoid valve (not shown), through the control fluid supply passage 142, control valve 400, and the first and second rocker passages 144 and 146 to the actuator piston assembly 160. The supply of hydraulic fluid may displace the actuator piston 180 against the bias of the lash spring 184 and into contact with lash screw 182 lower head end. More specifically, the lash screw 182 lower head end may be forced into contact with the stop surface provided by the internal shoulder of the actuator piston 180. This stop surface, which may be provided in other ways in alternative embodiments, limits the travel of the actuator piston 180 into an extended position. The check valve 440 (FIG. 9) in the control valve 400 may lock the actuator piston 180 into a fixed position relative to the rocker arm 100, as shown in FIG. 6. As a result, during this "locked" state, valve actuation motion applied by the compression release lobe 720 (FIG. 10) and the brake gas recirculation lobe 730, and the lower portion of the main exhaust lobe 710 may be imparted to the inboard exhaust valve 210 by the sliding pin 220. The actuator piston 180 may be maintained in an extended position, in contact with the lash screw 182 lower head end, for a plurality of engine cycles. Cessation of hydraulic fluid supply to the control valve 400 and actuator piston assembly 160 permits the actuator piston 180 to return to its upper position for positive power operation of the system.

FIG. 6 illustrates the rocker arm 100 and actuator piston assembly 160 as they are about to open or close the inboard exhaust valve 210 for a compression release engine braking event, about to open or close the inboard exhaust valve for main exhaust actuation, and about to open or close the inboard exhaust valve for brake gas recirculation, which valve positions are shown as points 750 in FIG. 11. FIG. 7 illustrates the rocker arm 100 and actuator piston assembly 160 as they are about to change from inboard valve actuation only through sliding pin 220 to actuation of both the inboard and outboard exhaust valves 210 and 212 through contact between the swivel foot 110 and the valve bridge 200, which valve positions are shown as points 760 in FIG. 11. As shown in FIG. 11, as a result of the different rocker ratios of the actuator piston assembly 160 relative to the swivel foot 110, actuation of the inboard exhaust valve 210 is handed off at points 760 between the sliding pin 220 and the valve bridge 200. FIG. 8 illustrates the rocker arm 100 and lost motion actuator 160 as they are at maximum rotation providing main exhaust valve actuation, which valve positions are shown as point 770 in FIG. 11. As a result, pivoting of the rocker arm causes the actuator piston assembly 160 to actuate the inboard exhaust valve 210 during a first part of the pivoting motion using the sliding pin 220, and the rocker arm swivel foot 110 to actuate the inboard exhaust valve during a second part of the pivoting motion using the valve bridge 200.

With reference to FIGS. 14-17, schematic views in partial cross-section are shown of an exhaust rocker arm 100 and an associated exhaust valve bridge 200 in accordance with a third embodiment of the present invention in which like reference characters refer to like elements to those illustrated in connection with the first and second embodiments of the invention. The valve bridge 200 may include a contact surface 221 instead of a sliding pin (shown in FIGS. 1-8 as element 220). It is appreciated that for all embodiments of the invention, a contact surface may be substituted for a sliding pin. The contact surface 221 may be provided above the inboard exhaust valve 210 and adjacent to a valve bridge contact surface provided at a center portion of the valve bridge 200 below the swivel foot 110. Downward movement of the valve bridge 200 may tilt the valve bridge to permit actuation of the inboard exhaust valve 210 without actuation of the outboard exhaust valve 212.

The rocker arm 100 may include an actuator piston assembly 160 comprising an actuator piston 196 and a hydraulically actuated mechanical locking assembly adapted to lock the actuator piston into an extended position relative to the rocker arm 100. The actuator piston 196 may be slidably disposed in an actuator piston bore 192 within the rocker arm 100 over the contact surface 221 of the valve bridge 200. The actuator piston may be biased relative to the rocker arm 100 by a spring 197

The mechanical locking assembly may include a locking piston 194 slidably disposed in a bore 119 in the rocker arm 100 adjacent to the actuator piston 196. The locking piston 194 may have a lower uneven surface 193 which contacts the upper end of the actuator piston 194 directly, or in an alternative embodiment, through a ball or roller 198. Preferably, the lower uneven surface 193 is stepped to provide two levels of recess, as shown in FIGS. 14-17. The lower uneven surface 193 recess may be shaped to engage the locking piston 194 or ball or roller 198 to move the actuator piston 196 towards or away from the contact surface 221 against the bias of the spring 197. The locking piston 194 may include a contact surface, preferably ramped, adjacent to a reset piston 112. A hydraulic passage 146 may extend from the bore 119 through the rocker arm 100 to the rocker shaft 140.

The reset piston 112 may be slidably disposed in a reset piston bore 118 above the center portion of the valve bridge 200. A swivel foot 110 may be provided at the lower end of the reset piston 112 to act on the center portion of the valve bridge. A reset piston lash adjustment screw 116 may be provided above the reset piston. A hydraulic fluid port 117 may communicate with the upper end of the reset piston bore 118. A spring (not shown) may be provided in the reset piston bore 118 above the reset piston 112 instead of, or in conjunction with, the hydraulic fluid port 117. This alternative spring may be provided elsewhere as well, so long as it acts to bias the reset piston 112 relative to the rocker arm 100. The reset piston 112 may include a contact surface 114 which is adapted to act on the contact surface provided on the locking piston 194. Preferably, the reset piston contact surface 114 may be ramped and shaped to mate with the locking piston contact surface, as shown in FIGS. 14-17. However, it is appreciated that alternative shapes for the reset piston and locking piston contact surfaces may be employed without departing from the intended scope of the invention.

The rocker shaft 140 may include one or more internal passages for the delivery of hydraulic fluid, such as engine oil, to the rocker arm 100 mounted thereon. Specifically, the rocker shaft 140 may include a constant fluid supply passage 144 and a control fluid supply passage 142. The rocker shaft bore may include one or more ports formed in the wall thereof to receive fluid from the fluid passages formed in the rocker shaft 140. The constant fluid supply passage 144 may provide hydraulic fluid to the hydraulic port 117 and/or to the swivel foot mechanism 110. The control fluid supply passage 142 may selectively supply hydraulic fluid to passage 146 and thus to the mechanical locking assembly including the locking piston 194.

During positive power operation, a solenoid valve (not shown) may be positioned so that no significant hydraulic fluid pressure is provided to the hydraulic passage 146. As a result, the locking piston 194 is maintained in a temporarily "locked" position relative to the actuator piston 196, shown in FIG. 14. In this "locked" position, the ball or roller 198 (or the upper surface of the actuator piston in alternative embodiments) engages the central, most recessed portion of the uneven surface 193 due to the bias of the actuator piston into the locking piston by the spring 197. Because hydraulic fluid pressure is not provided to the mechanical locking assembly, the spring 197 maintains the actuator piston 196 out of contact with the contact surface 221. In turn, the only valve actuation motion imparted to the exhaust valves 210 and 212 occurs as a result of the main exhaust lobe of cam 130 pivoting the swivel foot 110 against the valve bridge 200.

Figure 15:
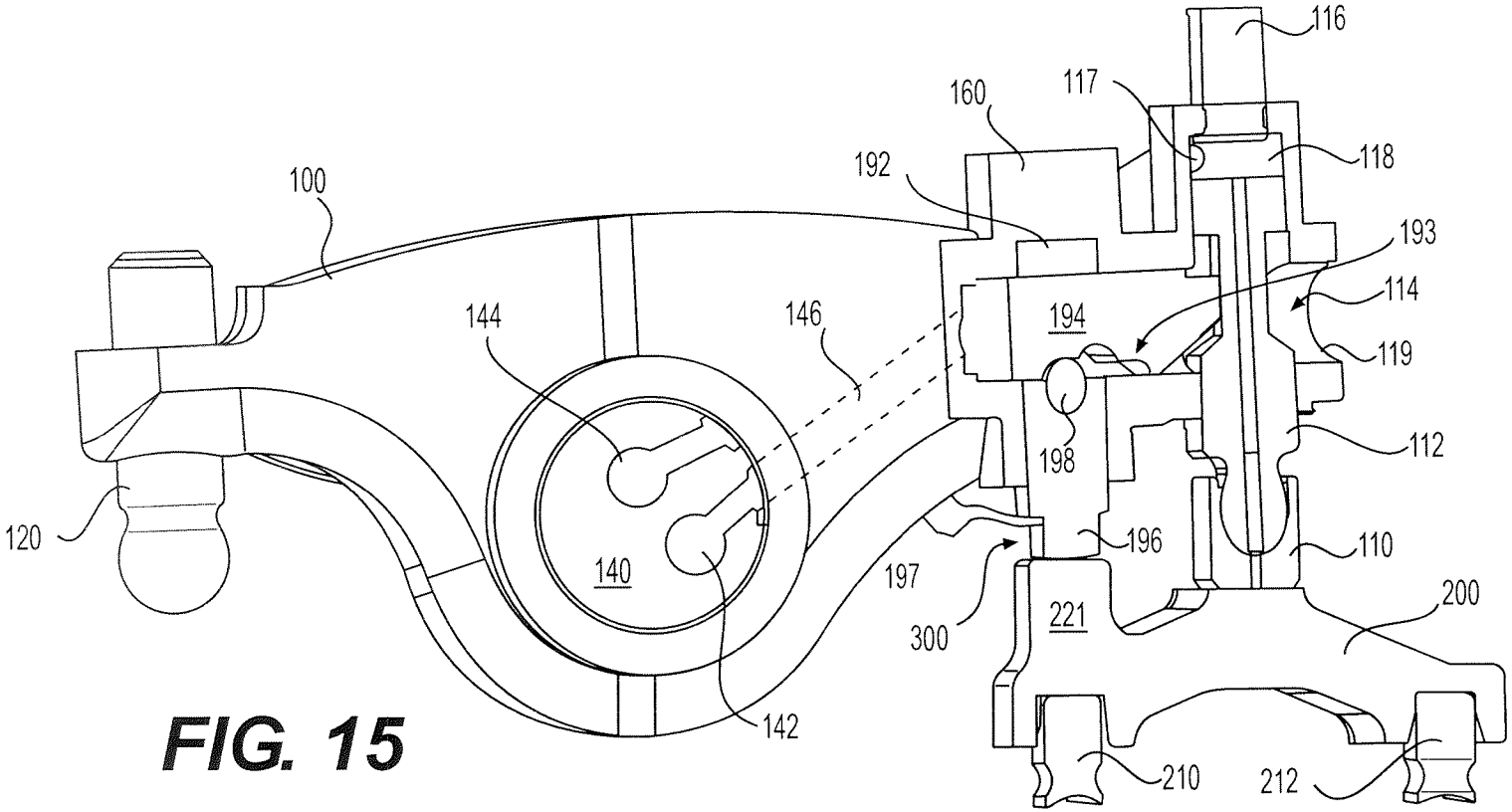
FIG. 15 is a schematic view in partial cross-section of a rocker arm and valve bridge system assembled in accordance with the third embodiment of the present invention in an engine brake on position at the initiation of an engine braking event.

During engine braking, hydraulic fluid may be selectively supplied from the solenoid valve, through the control fluid supply passage 142 and the hydraulic fluid passage 146 to the mechanical locking assembly including the locking piston 194. The supply of hydraulic fluid may force the locking piston 194 towards the reset piston 112. When the cam (not shown) is on base circle, the reset piston 112 may be biased out of the reset piston bore 118 by hydraulic fluid and/or a spring (not shown) such that the reset piston contact surface 114 accommodates the contact surface of the locking piston 194 and the locking piston slides laterally toward the reset piston and laterally relative to the actuator piston 196, as shown in FIG. 15. The sliding movement of the locking piston 194 causes the lower uneven surface 193 to displace the actuator piston 196 downward against the bias of the spring 197. As a result of the downward movement of the actuator piston 196 into an extended position relative to the rocker arm 100, valve actuation motion applied by the compression release lobe 720 (FIG. 10) and the brake gas recirculation lobe 730, and the lower portion of the main exhaust lobe 710 may be imparted to the inboard exhaust valve 210 through the contact surface 221, as shown in FIG. 16.

Figure 16:
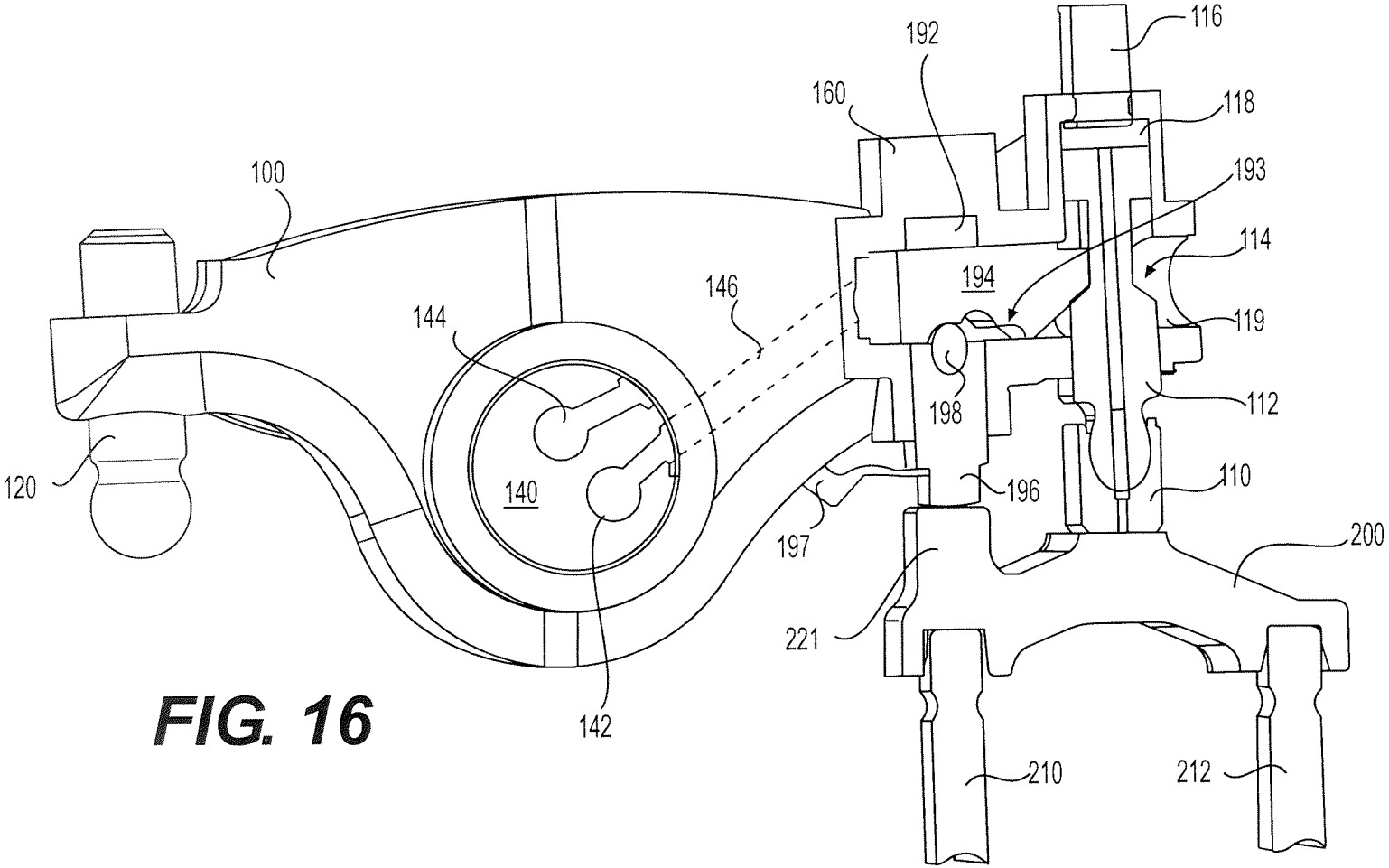
FIG. 16 is a schematic view in partial cross-section of a rocker arm and valve bridge system assembled in accordance with the third embodiment of the present invention in an engine brake on position during hand-off from engine braking to main event actuation.
Figure 17:
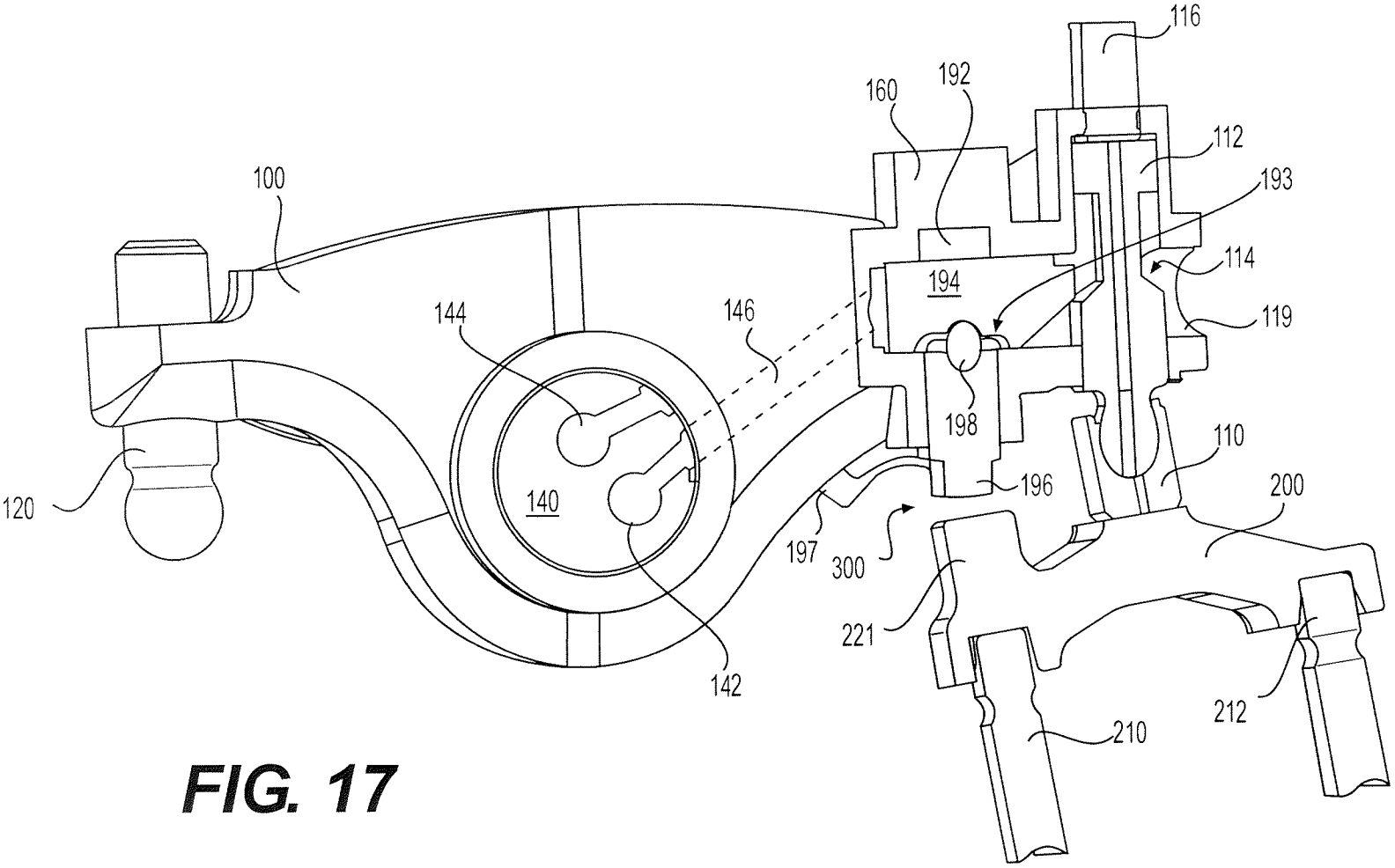
FIG. 17 is a schematic view in partial cross-section of a rocker arm and valve bridge system assembled in accordance with the third embodiment of the present invention in an engine brake on position at the point of maximum main event valve lift.

With continued reference to FIG. 16, the pivoting motion of the rocker arm 100 under the influence of the main exhaust lobe on the cam eventually causes the reset piston 112 to be forced upward into the bore 118 to a point at which the contact surface 114 of the reset piston mechanically engages the contact surface of the locking piston 194. Further pivoting of the rocker arm 100 causes the contact surface 114 of the reset piston 112 to mechanically force the locking piston 194 laterally away from the reset piston, as shown in FIG. 17. As a result of the lateral movement of the locking piston, the lower uneven surface 193 of the locking piston may permit the movement of the actuator piston 196 away from the contact surface 221 under the influence of the spring 197. In this manner the actuator piston 196 may be "reset" with each revolution of the cam (i.e., with each engine cycle). Cessation of hydraulic fluid supply to the mechanical locking assembly permits the locking piston 194 to remain in the temporarily "locked" position relative to the actuator piston 196 and the reset piston for return to positive power operation.

Figure 22:
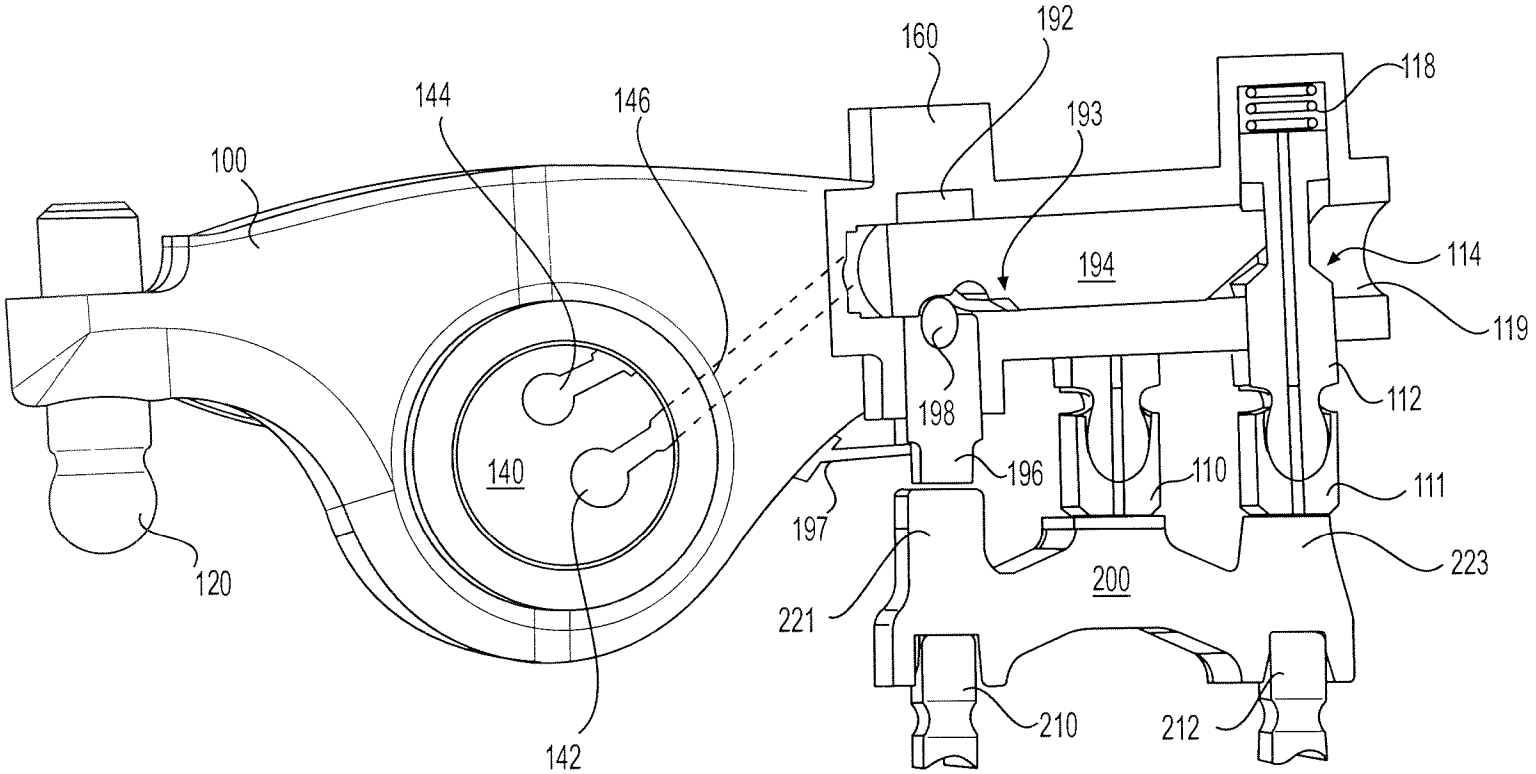
FIG. 22 is a schematic view in partial cross-section of a rocker arm and valve bridge system assembled in accordance with an alternative fifth embodiment of the present invention.

With reference to FIG. 22, in an alternative fifth embodiment of the invention shown in FIGS. 14-17 in which like reference characters refer to like elements, the reset piston 112 may include a swivel foot 111 which acts on a contact surface adjacent to the center portion of the valve bridge 200 over the outboard exhaust valve 212. In this embodiment, the rocker arm contact surface (i.e., swivel foot 110) which is adapted to act on the center portion of the valve bridge is provided between the reset piston 112 and the actuator piston 196. The embodiment shown in FIG. 22 operates like that shown in FIGS. 14-17 in all other respects.

With reference to FIGS. 18-21, schematic views in partial cross-section are shown of an exhaust rocker arm 100 and an associated exhaust valve bridge 200 in accordance with a fourth embodiment of the present invention in which like reference characters refer to like elements to those illustrated in connection with the first, second and third embodiments of the invention.

The rocker arm 100 may include an actuator piston assembly 160 comprising a cartridge housing 260, an actuator piston 262, and a hydraulically actuated mechanical locking assembly adapted to lock the actuator piston into an extended position relative to the rocker arm 100. The actuator piston 262 may be slidably disposed in an actuator piston bore within the housing 260 over the contact surface 221 of the valve bridge 200. The actuator piston may be biased relative to the rocker arm 100 by a spring 264.

The mechanical locking assembly may include a locking piston 238 slidably disposed in a locking piston bore 236 in the housing 260 adjacent to the actuator piston 262, and a spring 268 biasing the locking piston 238 relative to the housing 260. The housing 260 may include an threaded shaft 230 and slotted end 232 for adjusting the position of the housing relative to the rocker arm 100. The housing may further include a vent passage 266 extending from the locking piston bore 236 to an ambient surrounding the rocker arm.

The locking piston 238 may have a lower uneven surface 193 which contacts the upper end of the actuator piston 262 directly, or in an alternative embodiment, through a ball or roller (not shown). Preferably, the lower uneven surface 193 may have a ramped shape to facilitate sliding movement of the locking piston 238 laterally relative to the actuator piston 262. The lower uneven surface 193 recess may be shaped to engage the locking piston 238 to move the actuator piston 262 towards or away from the contact surface 221 against the bias of the spring 264.

A reset piston 242 may be slidably disposed in a reset piston bore 240 above the center portion of the valve bridge 200 and adjacent to the locking piston 238. A swivel foot 110 may be provided at the lower end of the reset piston 242 to act on the center portion of the valve bridge. A reset piston lash adjustment screw (of the type shown in FIGS. 14-17 as element 116) may be provided above the reset piston 242. A hydraulic fluid port connecting the continuous hydraulic fluid supply 144 may extend through the rocker arm 100 to the upper end of the reset piston bore 240 to provide lubricating fluid to the swivel foot 110 through cavity 244, and bias the reset piston towards the valve bridge 200. A spring (not shown) may be provided in the reset piston bore 240 above the reset piston 242 instead of, or in conjunction with, the hydraulic fluid port. This alternative spring may be provided elsewhere as well, so long as it acts to bias the reset piston 242 relative to the rocker arm 100. A reset piston vent passage 252 may extend through the second end of the rocker arm 100 from the reset piston bore 240 to the ambient.

Figure 18:
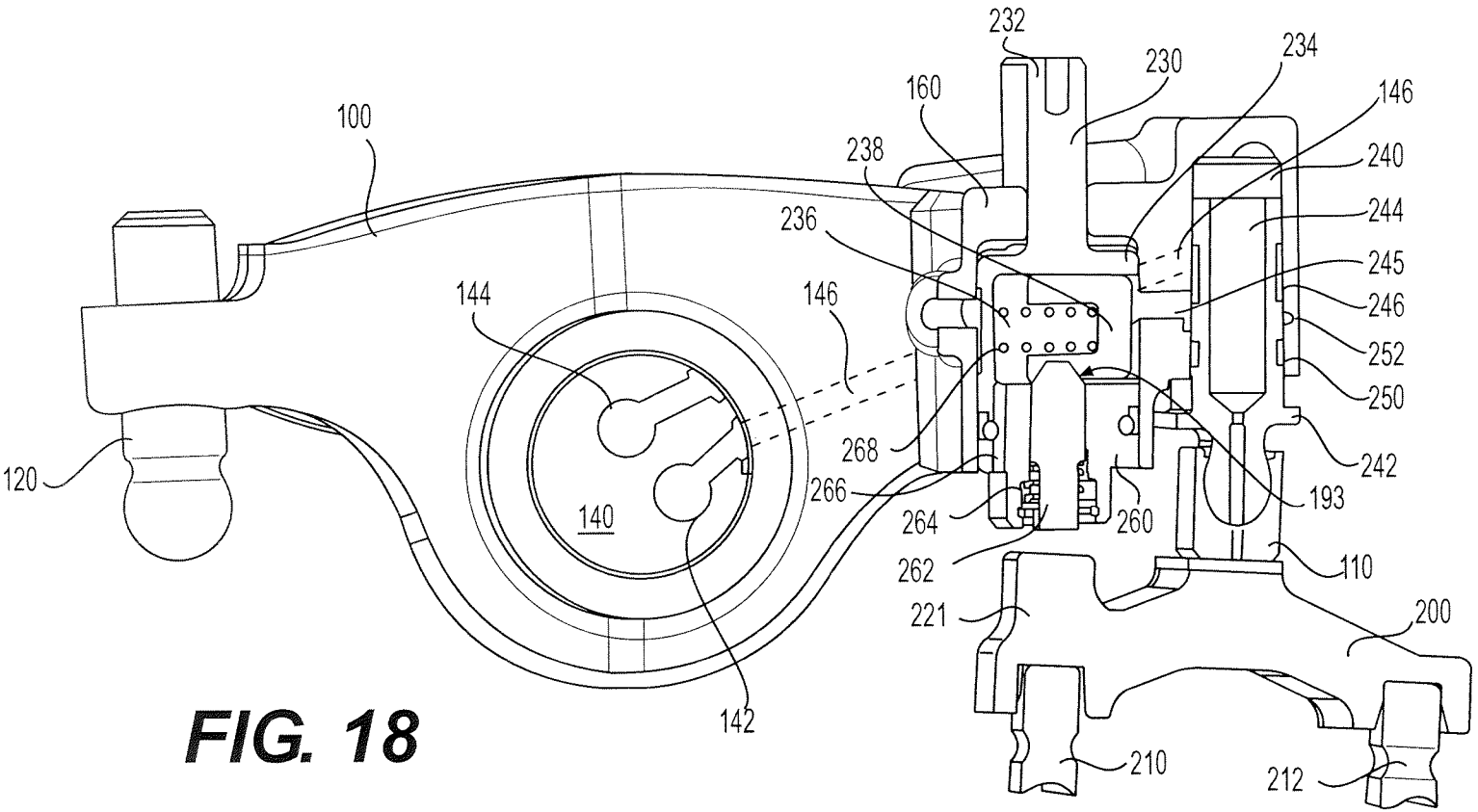
FIG. 18 is a schematic view in partial cross-section of a rocker arm and valve bridge system assembled in accordance with a fourth embodiment of the present invention in an engine brake off position.
Figure 19:
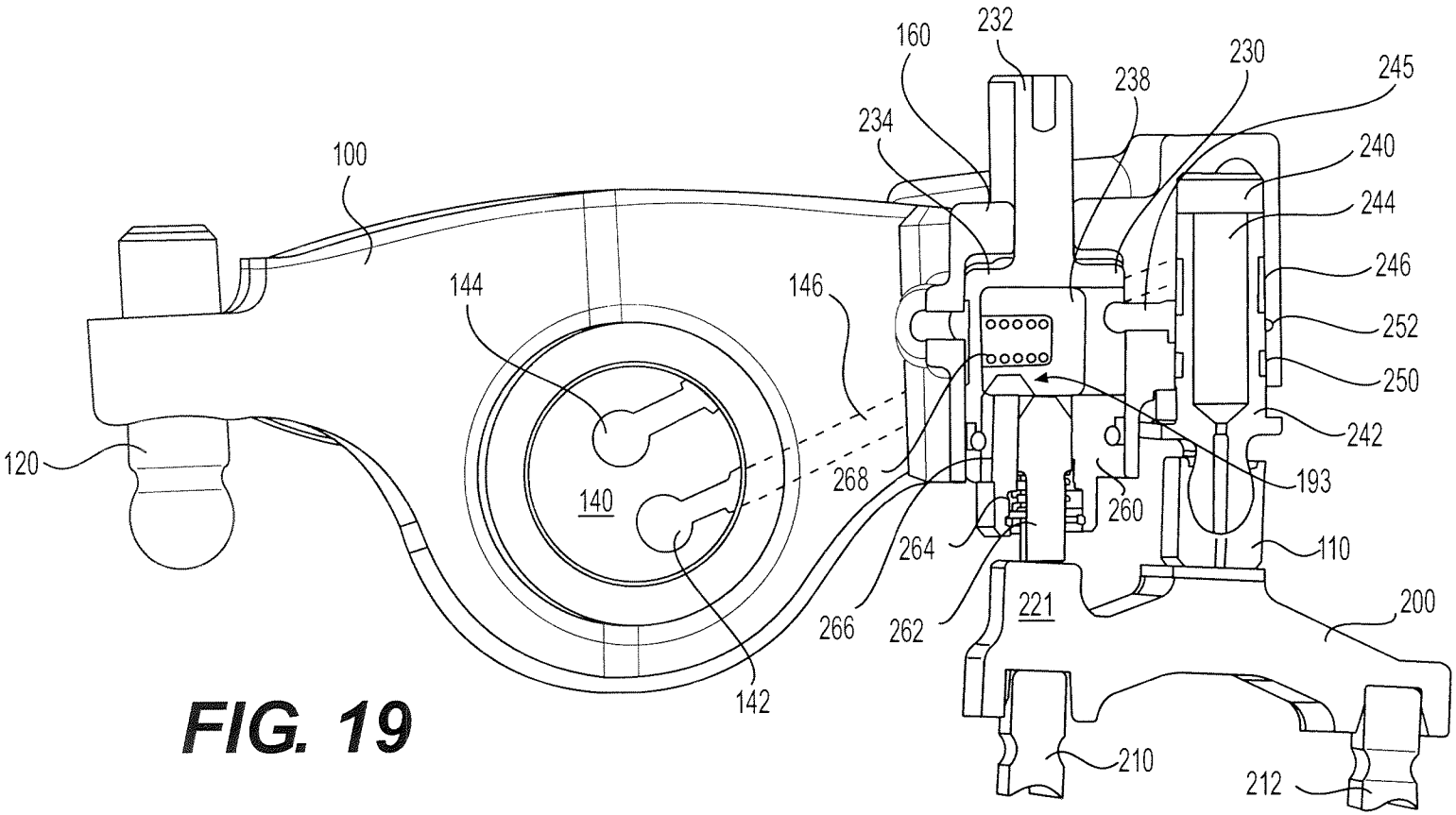
FIG. 19 is a schematic view in partial cross-section of a rocker arm and valve bridge system assembled in accordance with the fourth embodiment of the present invention in an engine brake on position at the initiation of an engine braking event.
Figure 20:
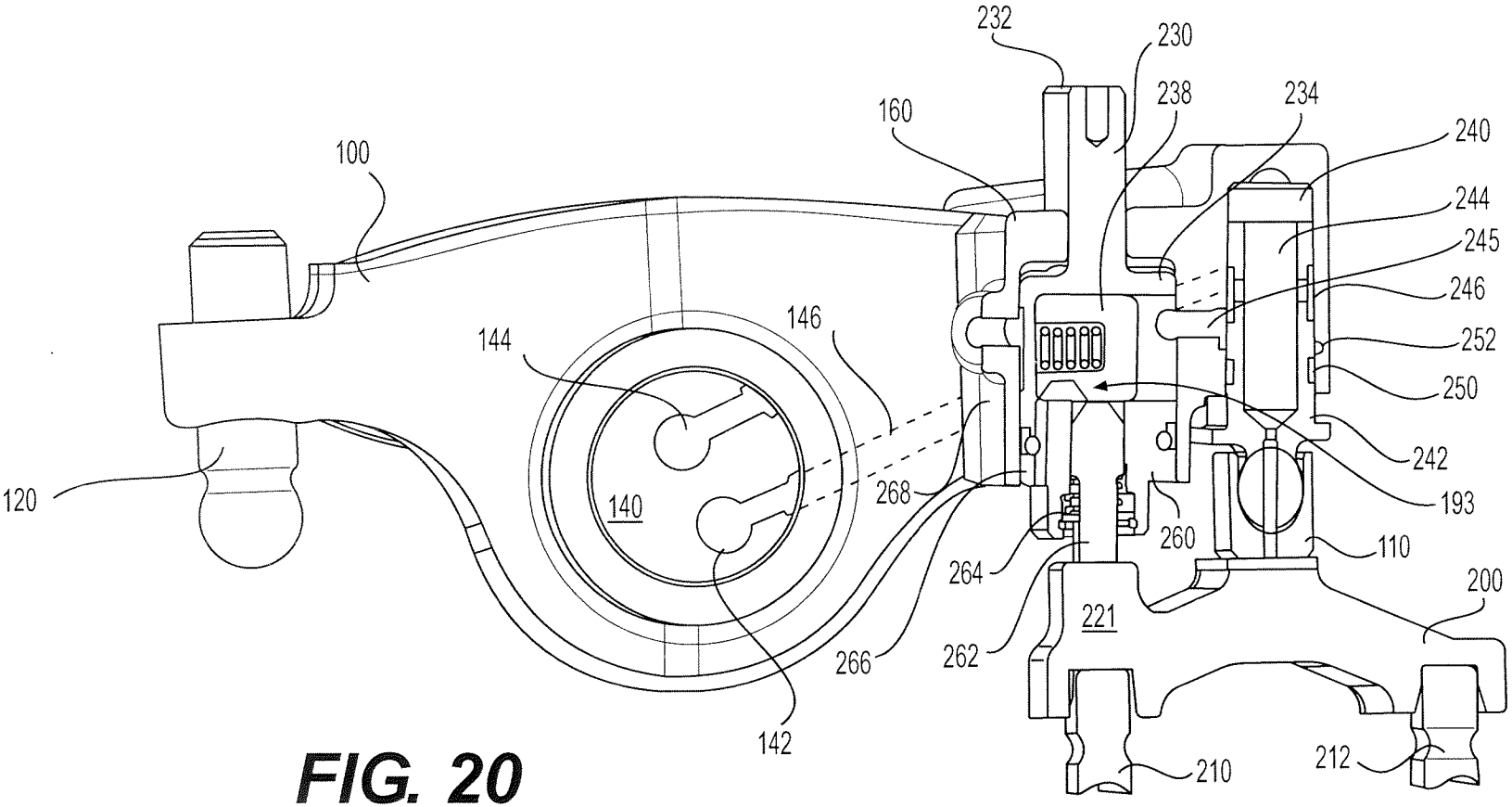
FIG. 20 is a schematic view in partial cross-section of a rocker arm and valve bridge system assembled in accordance with the fourth embodiment of the present invention in an engine brake on position during hand-off from engine braking to main event actuation.
Figure 21:
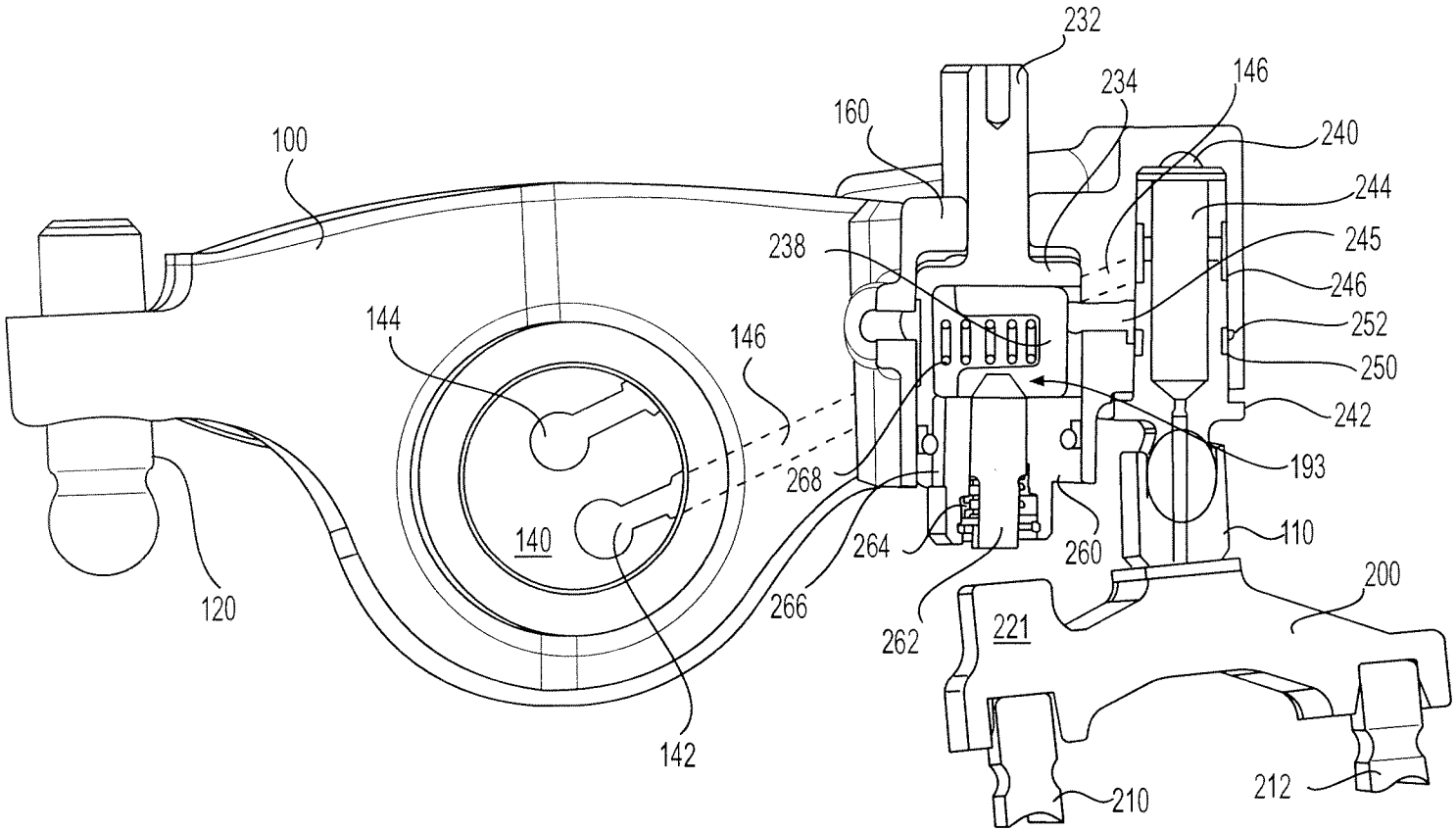
FIG. 21 is a schematic view in partial cross-section of a rocker arm and valve bridge system assembled in accordance with the fourth embodiment of the present invention in an engine brake on position at the point of maximum main event valve lift.

The reset piston 242 may further include a first annular recess 246 and a second annular recess 250. Hydraulic fluid provided to the fluid supply passage 142 in the rocker shaft 140 and the hydraulic passage 146 in the rocker arm 100 may flow through the first annular recess 246 to the locking piston bore 236 through the connecting passage 245 when the reset piston 242 is positioned as shown in FIGS. 18-20. When the reset piston is positioned as shown in FIG. 18, the first annular recess 246 hydraulically communicates with the connecting passage 245. Hydraulic fluid may be released from the locking piston bore 236 through the connecting passage 245 when the reset piston is positioned as shown in FIG. 21 so that the second annular recess 246 communicates with the reset piston vent passage 252.

During positive power operation, a solenoid valve (not shown) may be positioned so that no significant hydraulic fluid pressure is provided to the hydraulic passage 146. As a result, the locking piston 238 is forced laterally by the spring 268 and maintained in a temporarily "locked" position relative to the actuator piston 262, shown in FIG. 18. In this "locked" position, the upper surface of the actuator piston 262 engages the recessed portion of the uneven surface 193 due to the bias of the actuator piston into the locking piston 238 by the spring 264. Because hydraulic fluid pressure is not provided to the mechanical locking assembly, the spring 264 maintains the actuator piston 262 out of contact with the contact surface 221. In turn, the only valve actuation motion imparted to the exhaust valves 210 and 212 occurs as a result of the main exhaust lobe of cam 130 pivoting the swivel foot 110 against the valve bridge 200.

During engine braking, with reference to FIG. 18, hydraulic fluid may be selectively supplied from the solenoid valve, through the control fluid supply passage 142 and the hydraulic fluid passage 146 to the mechanical locking assembly including the locking piston 238. The hydraulic fluid reaches the locking piston 238 when the first annular recess 246 registers with the connecting passage 245. The supply of hydraulic fluid may force the locking piston 238 to move relative to the housing 260 against the bias force of the spring 268. The lateral sliding movement of the locking piston 238 relative to the actuator piston 262 causes the lower uneven surface 193 to displace the actuator piston 262 downward against the bias of the spring 264, as shown in FIG. 19. As a result of the downward movement of the actuator piston 262 into an extended position relative to the rocker arm 100, valve actuation motion applied by the compression release lobe 720 (FIG. 10) and the brake gas recirculation lobe 730, and the lower portion of the main exhaust lobe 710 may be imparted to the inboard exhaust valve 210 through the contact surface 221, as shown in FIG. 20.

With continued reference to FIG. 20, the pivoting motion of the rocker arm 100 under the influence of the main exhaust bump on the cam eventually causes the reset piston 242 to be forced upward into the bore 240 to a point just before the second annular recess 250 registers with the reset piston vent passage 252. With reference to FIG. 21, further pivoting of the rocker arm 100 causes the second annular recess 250 to register with the reset piston vent passage 252 thereby hydraulically unlocking the locking piston 238. Hydraulic unlocking of the locking piston 238 permits the locking piston to move laterally under the influence of the spring 268, which in turn causes the lower uneven surface 193 of the locking piston to receive actuator piston 262 which is biased upward by the spring 264. In this manner the actuator piston 262 may be "reset" to an unextended position with each revolution of the cam (i.e., with each engine cycle). Cessation of hydraulic fluid supply to the mechanical locking assembly permits the locking piston 238 to remain in the temporarily "locked" position relative to the actuator piston 262 for return to positive power operation.

Figure 23:
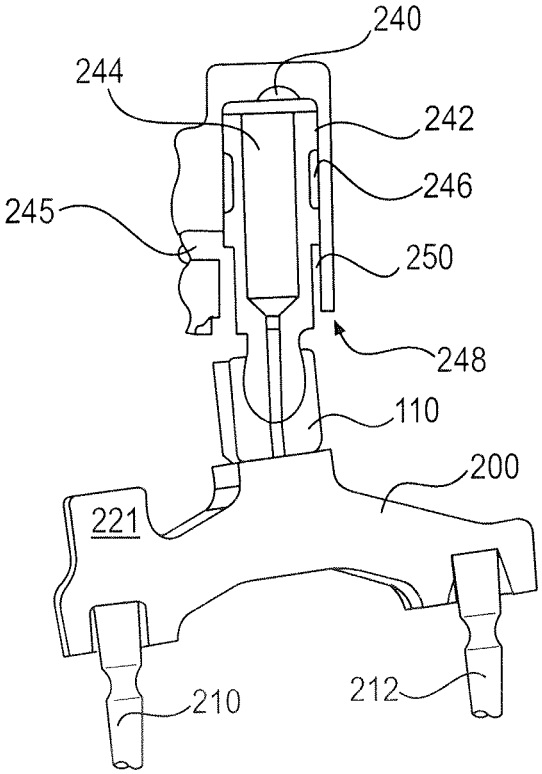
FIG. 23 is a schematic view in partial cross-section of a portion of a rocker arm and valve bridge system assembled in accordance with an alternative sixth embodiment of the present invention.
Figure 14:
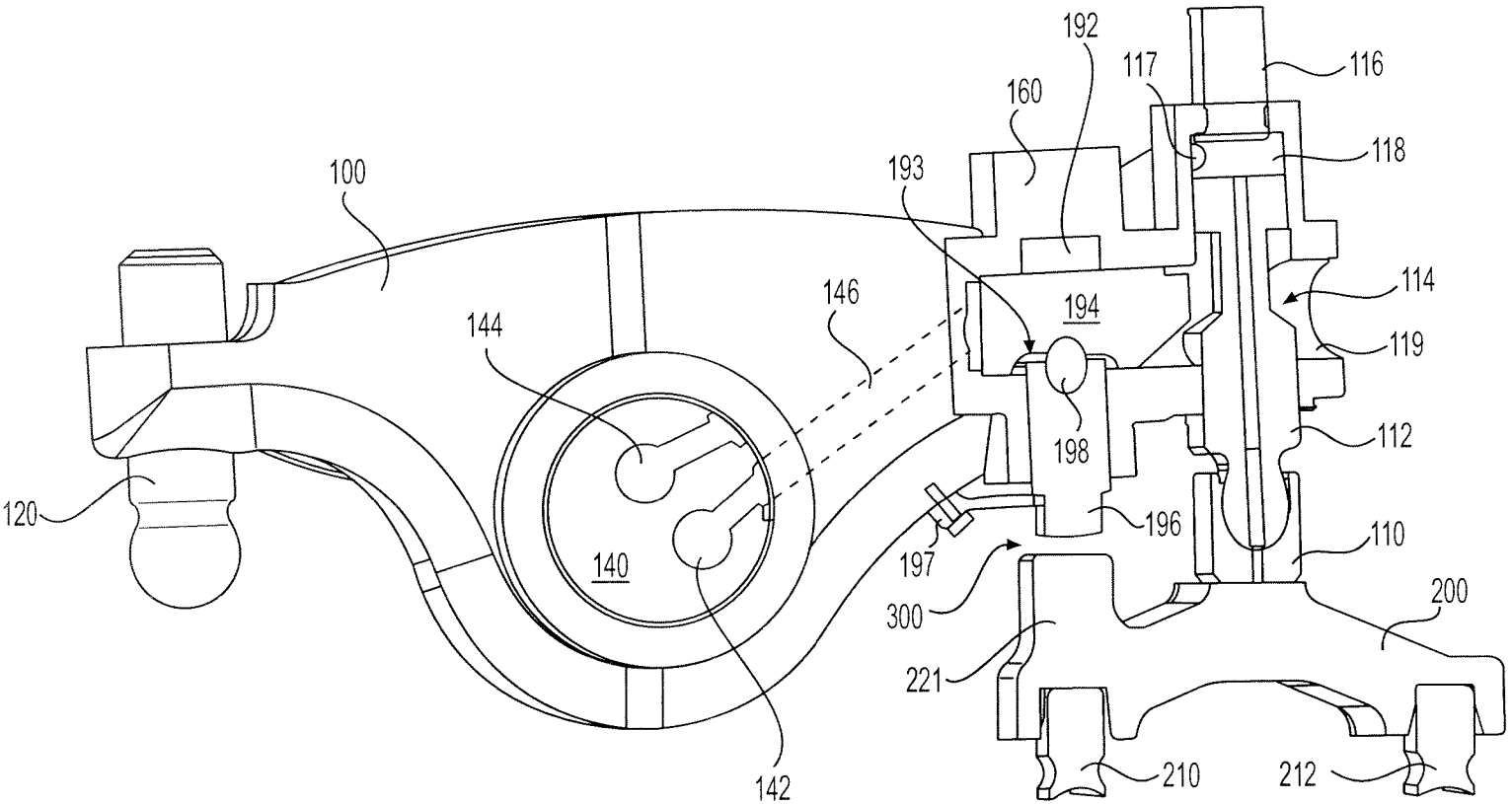
FIG. 14 is a schematic view in partial cross-section of a rocker arm and valve bridge system assembled in accordance with a third embodiment of the present invention in an engine brake off position.

With reference to FIG. 23, in an alternative sixth embodiment of the invention shown in FIGS. 18-21, in which like reference characters refer to like elements, it is shown that the reset piston second annular recess 250 may selectively provide hydraulic fluid communication between the connecting passage 245 and an ambient via opening 248. In this manner, opening 248 may provide an alternative route for the venting hydraulic fluid from the connecting passage 245 to reset the locking piston (not shown) to that shown in FIGS. 18-21. The system shown in FIG. 23 may operate in the same manner as that shown in FIGS. 18-21 in all other respects.

It will be apparent to those skilled in the art that variations and modifications of the present invention can be made without departing from the scope or spirit of the invention. For example, it is appreciated that the exhaust rocker arm 100 could be implemented as an intake rocker arm, or an auxiliary rocker arm, without departing from the intended scope of the invention. These and other modifications to the above-described embodiments of the invention may be made without departing from the intended scope of the invention.

What is claimed is:

1. A system for actuating an engine valve comprising:

a rocker arm having a first end distal from a valve bridge and a second end proximal to the valve bridge, said rocker arm having a first surface at the second end adapted to act on a center portion of the valve bridge;

a sliding pin provided in, or a contact surface provided on, said valve bridge adjacent to the center portion, said valve bridge having a lower surface below said sliding pin or contact surface which is adapted to contact an engine valve;

an actuator piston slidably disposed within and extending from the rocker arm at a point between the rocker arm first end and second end, said actuator piston having a lower surface adapted to contact the sliding pin or contact surface of the valve bridge;

a hydraulically actuated mechanical locking assembly disposed in said rocker arm, said mechanical locking assembly contacting said actuator piston; and a hydraulic passage extending through the rocker arm to the mechanical locking assembly.

2. The system of claim 1, further comprising one or more springs biasing the actuator piston relative to the rocker arm.

3. The system of claim 1, further comprising a control valve provided in said rocker arm.

4. The system of claim 1, wherein the mechanical locking assembly comprises:

an inner plunger slidably disposed within the actuator piston;

one or more ball, roller, or wedge locking elements in contact with the inner plunger and the actuator piston; and one or more recesses provided in a wall surrounding the actuator piston, said recesses adapted to receive the one or more ball, roller, or wedge locking elements.

5. The system of claim 4, wherein the inner plunger includes a ramped portion adapted to engage the one or more ball, roller, or wedge locking elements.

6. The system of claim 4, further comprising a spring biasing the inner plunger relative to the actuator piston.

7. The system of claim 1, wherein the mechanical locking assembly comprises:

a locking piston slidably disposed in the rocker arm adjacent to the actuator piston, said locking piston having lower uneven surface in contact with the actuator piston; and a reset piston slidably disposed in the rocker arm adjacent to the locking piston, said reset piston having a contact surface adapted to engage the locking piston in such a manner as to move the locking piston relative to the reset piston as a result of movement of the reset piston.

8. The system of claim 7, further comprising a hydraulic fluid passage extending through the rocker arm to a bore in which the reset piston is disposed.

9. The system of claim 7, further comprising a spring provided in a bore in which the reset piston is disposed.

10. The system of claim 7, further comprising a ball or roller disposed between the locking piston and the actuator piston in the locking piston lower uneven surface.

11. The system of claim 7, wherein the locking piston lower uneven surface is stepped to provide two levels of recess.

12. The system of claim 7, further comprising a reset piston lash adjustment screw extending into the rocker arm above the reset piston.

13. The system of claim 7, wherein the locking piston is slidable in a direction substantially orthogonal to the direction in which the actuator piston is slidable.

14. The system of claim 7, wherein the rocker arm first surface is provided by a lower portion of the reset piston.

15. The system of claim 7, wherein the rocker arm first surface is provided between the reset piston and the actuator piston.

16. The system of claim 7, wherein the reset piston contact surface is ramped and the locking piston has a ramped surface which engages the reset piston contact surface.

17. The system of claim 1, wherein the mechanical locking assembly comprises:

a locking piston slidably disposed in the rocker arm adjacent to the actuator piston, said locking piston having a lower uneven surface adapted to engage an upper surface of the actuator piston;

a spring biasing the locking piston in a lateral direction relative to the direction in which the actuator piston is slidable;

a reset piston slidably disposed in the rocker arm adjacent to the locking piston, said reset piston having an annular recess; and a hydraulic fluid passage extending through the rocker arm from a bore in which the locking piston is disposed to the reset piston bore, wherein the reset piston annular recess provides selective hydraulic communication with an ambient as a result of the movement of the reset piston.

18. The system of claim 17, further comprising a reset piston vent passage extending through the second end or the rocker arm from the reset piston bore to the ambient.

19. The system of claim 17, wherein the reset piston annular recess provides selective hydraulic communication between the ambient and the hydraulic fluid passage extending from the locking piston bore to the reset piston bore.

20. The system of claim 17, further comprising a hydraulic fluid passage extending through the rocker arm to the reset piston bore.

21. The system of claim 17, further comprising a spring biasing the reset piston towards the valve bridge.

22. The system of claim 17, further comprising a locking piston vent passage extending from the locking piston bore to the ambient.

23. The system of claim 17, further comprising a cartridge disposed in the rocker arm, said cartridge housing the locking piston and actuator piston, and said cartridge having a threaded portion to adjust the position of the cartridge relative to the rocker arm.

24. The system of claim 17, wherein the locking piston lower uneven surface includes one or more ramped surfaces.

25. The system of claim 3, further comprising a rocker arm lash adjustment assembly provided at the first end of the rocker arm.

26. A method of actuating an engine valve using a valve bridge and a rocker arm, said rocker arm having an actuator piston assembly adapted to contact the valve bridge and a reset piston assembly in contact with the actuator piston assembly, said method comprising the steps of:

supplying hydraulic fluid to the actuator piston assembly to cause it to attain an extended position relative to the rocker arm and to mechanically engage the reset piston assembly; and pivoting the rocker arm so that the actuator piston assembly actuates the engine valve and so that the reset piston assembly is forced to move relative to the rocker arm thereby mechanically forcing the actuator piston assembly to move relative to the reset piston assembly and unlock the actuator piston assembly from the extended position.

27. The method of claim 26 wherein the step of supplying hydraulic fluid causes a locking piston to move relative to an actuator piston thereby causing the actuator piston to attain the extended position.

28. The method of claim 27, wherein the actuator piston assembly is forced to move as a result of a reset piston surface mechanically engaging a locking piston surface provided in the actuator piston assembly.

29. The method of claim 27, wherein the reset piston surface is ramped.

30. The method of claim 29, wherein the locking piston surface is ramped.

31. The method of claim 26, further comprising the step of moving the actuator piston assembly away from the valve bridge and into a retracted position relative to the rocker arm as a result of unlocking the actuator piston assembly.

32. A method of actuating an engine valve using a valve bridge and a rocker arm, said rocker arm having an actuator piston assembly adapted to contact the valve bridge and a reset piston assembly adjacent to the actuator piston assembly, said method comprising the steps of:

supplying hydraulic fluid to the actuator piston assembly to cause it to extend from the rocker arm and to become mechanically locked into an extended position; and pivoting the rocker arm so that the actuator piston assembly actuates the engine valve and so that the reset piston assembly is forced to move relative to the rocker arm and hydraulically unlock the actuator piston assembly from the extended position.

33. The method of claim 32 wherein the step of supplying hydraulic fluid causes a locking piston to move relative to an actuator piston thereby causing the actuator piston to attain the extended position.

34. The method of claim 32 further comprising the step of moving the actuator piston assembly away from the valve bridge and into a retracted position relative to the rocker arm as a result of unlocking the actuator piston assembly.

35. A method of actuating an engine valve using a valve bridge and a rocker shaft mounted rocker arm, said rocker arm having a first contact surface adapted to contact a center portion of the valve bridge and an actuator piston assembly adapted to contact a portion of the valve bridge closer to the rocker shaft than the center portion of the valve bridge, said method comprising the steps of:

supplying hydraulic fluid to the actuator piston assembly to cause it to extend from the rocker arm and to become mechanically locked into an extended position; and pivoting the rocker arm so that the actuator piston assembly actuates the engine valve during a first part of the pivoting motion and the rocker arm first contact surface actuates the engine valve during a second part of the pivoting motion.

36. The method of claim 35 further comprising the step of maintaining the actuator piston assembly in the extended position for a plurality of engine cycles.

* * * * *